US010833411B2

(12) United States Patent
Anguera Pros et al.

(10) Patent No.: US 10,833,411 B2
(45) **Date of Patent: *Nov. 10, 2020**

(54) CONCENTRATED WIRELESS DEVICE PROVIDING OPERABILITY IN MULTIPLE FREQUENCY REGIONS

(71) Applicant: Fractus Antennas, S.L., Barcelona (ES)

(72) Inventors: Jaume Anguera Pros, Vinaros (ES); Cristina Picher Planellas, Barcelona (ES); Aurora Andujar Linares, Barcelona (ES); Carles Puente Baliarda, Barcelona (ES)

(73) Assignee: Fractus Antennas, S.L., Barcelona (ES)

( * ) Notice: Subject to any disclaimer, the term of this patent is extended or adjusted under 35 U.S.C. 154(b) by 0 days.

This patent is subject to a terminal disclaimer.

(21) Appl. No.: 15/608,461

(22) Filed: May 30, 2017

(65) Prior Publication Data

US 2017/0288309 A1 Oct. 5, 2017

Related U.S. Application Data

(60) Division of application No. 15/163,469, filed on May 24, 2016, now abandoned, which is a continuation of (Continued)

(51) Int. Cl.

| | |
|---|---|
| ***H01Q 1/24*** | (2006.01) |
| ***H01Q 5/335*** | (2015.01) |
| ***H01Q 9/04*** | (2006.01) |

(52) U.S. Cl.

CPC ..... *H01Q 9/0407* (2013.01); *H01Q 1/24* (2013.01); *H01Q 1/241* (2013.01); *H01Q 1/243* (2013.01);

(Continued)

(58) Field of Classification Search

CPC ..... H01Q 1/2283; H01Q 1/24; H01Q 1/241; H01Q 1/242; H01Q 1/243; H01Q 1/245;

(Continued)

(56) References Cited

U.S. PATENT DOCUMENTS

| | | | |
|---|---|---|---|
| 6,184,844 | B1 | 2/2001 | Filipovic et al. |
| 6,388,631 | B1 | 5/2002 | Livingston et al. |

(Continued)

FOREIGN PATENT DOCUMENTS

| | | | |
|---|---|---|---|
| JP | 2005-175846 | A | 6/2005 |
| WO | 02/13306 | | 2/2002 |

(Continued)

OTHER PUBLICATIONS

Villanen, et al. "A Coupling element-based quad-band antenna structure for mobile terminals," Microwave and Opticals Technology Letters, p. 1277-1280, vol. 49, Jun. 2007.

(Continued)

*Primary Examiner* — Daniel Munoz
*Assistant Examiner* — Patrick R Holecek
(74) *Attorney, Agent, or Firm* — Edell, Shapiro & Finnan LLC

(57) ABSTRACT

A radiating system for transmitting and receiving signals in first and second frequency regions includes a radiating structure, a radiofrequency system, and an external port. The radiating structure has first and second isolated radiation boosters coupled to a ground plane layer. A first internal port of the radiating structure is between the first radiation booster and the ground plane layer, and a second internal port is between the second radiation booster and the ground plane layer. A distance between the two internal ports is less than 0.06 times a wavelength of the lowest frequency. The maximum size of the first and second radiation boosters is smaller than 1/30 times the wavelength of the lowest fre- (Continued)

quency. The radiofrequency system includes two ports connected respectively to the first and the second internal ports of the radiating structure, and a port connected to the external port of the radiating system.

20 Claims, 37 Drawing Sheets

Related U.S. Application Data application No. 13/803,100, filed on Mar. 14, 2013, now Pat. No. 9,379,443.

(60) Provisional application No. 61/671,906, filed on Jul. 16, 2012.

(52) U.S. Cl.
CPC ..... *H01Q 1/245* (2013.01); *H01Q 5/335* (2015.01); *H01Q 9/0414* (2013.01)

(58) Field of Classification Search
CPC ..... H01Q 1/48; H01Q 5/314; H01Q 5/321; H01Q 5/335; H01Q 5/357; H01Q 5/364; H01Q 5/371; H01Q 9/04; H01Q 9/0407; H01Q 9/0414; H03H 7/38
See application file for complete search history.

(56) References Cited

U.S. PATENT DOCUMENTS

| | | | | |
|---|---|---|---|---|
| 6,734,828 | B2 * | 5/2004 | Shor | H01O 5/00 343/700 MS |
| 6,762,723 | B2 | 7/2004 | Nallo et al. | |
| 6,791,498 | B2 | 9/2004 | Boyle et al. | |
| 6,795,027 | B2 | 9/2004 | Boyle | |
| 6,873,299 | B2 | 3/2005 | Dakeya et al. | |
| 7,274,340 | B2 | 9/2007 | Ozden et al. | |
| 7,683,839 | B2 | 3/2010 | Ollikainen et al. | |
| 7,741,998 | B2 * | 6/2010 | Thornell-Pers | H01Q 1/243 343/700 MS |
| 7,760,146 | B2 | 7/2010 | Ollikainen | |
| 8,237,615 | B2 | 8/2012 | Anguera et al. | |
| 8,780,007 | B2 * | 7/2014 | Tseng | H01Q 1/243 343/876 |
| 9,112,284 | B2 | 8/2015 | Andujar Linares et al. | |
| 9,331,389 | B2 | 5/2016 | Anguera Pros et al. | |
| 9,537,223 | B2 | 1/2017 | Hall et al. | |
| 9,577,325 | B2 | 2/2017 | Andujar Linares et al. | |
| 2003/0063036 | A1 | 4/2003 | Sato et al. | |
| 2006/0214856 | A1 | 9/2006 | Nakano et al. | |
| 2006/0214857 | A1 | 9/2006 | Ollikainen | |
| 2007/0146212 | A1 | 6/2007 | Ozden et al. | |
| 2007/0152886 | A1 | 7/2007 | Baliarda et al. | |
| 2008/0018543 | A1 | 1/2008 | Baliarda et al. | |
| 2008/0042909 | A1 | 2/2008 | Puente Baliarda et al. | |
| 2008/0174507 | A1 | 7/2008 | Illera et al. | |
| 2008/0198082 | A1 * | 8/2008 | Soler Castany | H01Q 1/242 343/770 |
| 2009/0051597 | A1 | 2/2009 | Wen et al. | |
| 2009/0128425 | A1 | 5/2009 | Kim et al. | |
| 2010/0109955 | A1 * | 5/2010 | Anguera | H01Q 1/243 343/702 |
| 2010/0176999 | A1 * | 7/2010 | Anguera | H01Q 1/243 343/702 |
| 2010/0188300 | A1 * | 7/2010 | Anguera | H01Q 1/243 343/702 |
| 2011/0117976 | A1 | 5/2011 | Nishikido et al. | |
| 2012/0007690 | A1 | 1/2012 | Van Bezooijen | |
| 2012/0288762 | A1 | 11/2012 | Hardin et al. | |
| 2013/0004658 | A1 | 1/2013 | Yang | |

FOREIGN PATENT DOCUMENTS

| | | | |
|---|---|---|---|
| WO | 02/095869 | | 11/2002 |
| WO | 03023900 | | 3/2003 |
| WO | 2007/039668 | | 4/2007 |
| WO | 2007074369 | A1 | 7/2007 |
| WO | 2007/128340 | | 11/2007 |
| WO | 2007/141187 | | 12/2007 |
| WO | 2008009391 | A2 | 1/2008 |
| WO | 2008119699 | | 10/2008 |
| WO | 2010/015364 | | 2/2010 |
| WO | 2010/015365 | | 2/2010 |
| WO | 2011/095330 | | 8/2011 |
| WO | 2012/017013 | | 2/2012 |
| WO | 2012/100178 | | 7/2012 |

OTHER PUBLICATIONS

Holopainen, J. et al, Antenna for handheld DVB terminal, Antenna Technology: Small Antennas and Novel Metamaterials (IWAT), 2006. IEEE International Workshop on, Mar. 8, 2006.

Villanen, J., Coupling element based mobile terminal antenna structures, Antennas and Propagation, IEEE Transactions on, Jul. 2006.

Vainikainen, P., Design and measurements of small antennas for mobile terminals—Part II, Helsinki University of Technology, Jun. 22, 2006.

Holopainen, J., Antenna for handheld DVB terminal, Helsinki University of Technology, May 17, 2005.

Villanen, J., Mobile broadband antennas, Unión Cientifica Internacional de la Radio (URSI), 20th, Gandia, 2005. Simposium Nacional de la, Oct. 20, 2005.

Villanen, J., Compact antenna structures for mobile handsets, Vehicular Technology (VTC), 58th, 2003. IEEE Conference, Oct. 6, 2003.

Buchholz, M. et al, Analysis, realisation and measurement of broadband miniature antennas for digital TV receivers in handheld terminals, Broadband Multimedia Systems and Broadcasting Preliminary Program (BMSB), 2006. IEEE International Symposium on, Apr. 6, 2006.

Villanen, J., Mobile terminal antennas, Helsinki University of Technology, Feb. 2005.

Holopainen, J., Mobile terminal antennas implemented by using direct coupling, Antennas and Propagation (EUCAP), 1st, Nice, 2006. European Conference on, Nov. 6, 2006.

Valkonen, R. et al., Broadband tuning of mobile terminal antennas, Antennas and Propagation (EUCAP), 2nd, 2007. European Conference on, Nov. 8, 2007.

Shan, S. P., The electrical engineering handbook, Boca Raton CRC Press, Jan. 14, 2000.

Wong, Kin-Lu, Planar antennas for wireless communications, Wiley Interscience, 2003.

Poutanen, J., Interaction between mobile terminal antenna and user, Helsinki University of Technology, Sep. 10, 2007.

Aguilar, D.; Anguera, J.; Puente, C.; Ribo, M., Small handset antenna for FM reception, Microwave and Optical Technology Letters, Oct. 2008.

Kyro, Mikko; Mustonen, Maria et al, Dual-element antenna for DVB-H terminal, Loughborough (LAPC), 2008. Antennas and Propagation Conference, Mar. 17, 2008.

Chaudhury, S. Kabir; Chaloupka, H. J.; Ziroff, A., Novel MIMO antennas for mobile terminal, Microwave Conference (EuMC), 38th, 2008. European, Oct. 27, 2008.

Arzemi, A.; Tovainen, J.; Laitinen, T. et al, On diversity performance of Two-Element coupling element based antenna structure for mobile terminal, Antennas and Propagation (EUCAP), 4th, 2010. European Conference on, Apr. 12, 2010.

Valkonen, R.; Luxey, C.; Holopainen, J., Frequency-reconfigurable mobile terminal antenna with MEMS switches, Antennas and Propagation (EUCAP), 4th, 2010. European Conference on, Apr. 12, 2010.

Villanen, J., Miniaturization and evaluation methods of mobile terminal antenna structures, Helsinki University of Technology. Radio Laboratory Publications, Sep. 3, 2007.

(56) References Cited

OTHER PUBLICATIONS

Holopainen, J.; Villanen, J.; Valkonen, R. et al , Mobile terminal antennas implemented using optimized direct feed, Antenna Technology (IWAT), 2009. IEEE International Workshop on, Mar. 2, 2009.
Zhao, H.; Lin, G.; Beckman, C., Design of a coupling element based penta-band mobile phone antenna, Loughborough (LAPC), 2009. Antennas and Propagation Conference, Nov. 16, 2009.
Vainikainen, P; Mustonen, M; Kyrö, M. et al, Recent development of MIMO antennas and their evaluation for small mobile terminals, Microwave Radar and Wireless Communications (MIKON), 17th, 2008. International Conference on, May 19, 2008.
Andujar, A.; Anguera, J.; Puente, C., Ground plane boosters to provide multi-band operation in wireless handheld devices, Antennas and Propagation (EUCAP), 5th, 2011. European Conference on, Apr. 11, 2011.
Andujar, A.; Anguera, J.; Puente, C., Ground plane boosters as a compact antenna technology for wireless handheld devices, Antennas and Propagation, IEEE Transactions on, May 2011.
Song, C.T.P. et al, Wide tunable dual-band reconfigurable antenna for future wireless devices, Loughborough (LAPC), 2009. Antennas and Propagation Conference, Nov. 16, 2009.
Martinez, M., Design of antennas for mobile communications devices: practical aspects, Antennas and Propagation Society (APS), 2011. IEEE International Symposium, Aug. 2011.
Picher, C.; Anguera, J.; Andujar, A.; Puente, C., Multiband handset antennas by combining monopoles and Intelligent ground planes, Antennas and Propagation (EUCAP), 6th, 2012. European Conference on, Mar. 2012.
Andujar, A.; Anguera, J.; Picher, C.; Puente, C., Human head interaction over ground plane booster antenna technology: functional and biological analysis, Progress in Electromagnetics Research (PIER) B, Jun. 2012.
Rahola, J.; Ollikainen, J., Optimal antenna placement for mobile terminals using characteristic mode analysis, Antennas and Propagation (EUCAP), 1st, Nice, 2006. European Conference on, Nov. 2006.
Martens, R.; Safin, E.; Manteuffel, D., Selective excitation of characteristic modes on small terminals, Antennas and Propagation (EUCAP), 5th, 2011. European Conference on, Apr. 2011.
Rao, Q.; Wen, G., Ultra-small cubic folded strip antenna for handset devices, Antennas and Propagation Society (APS), 2008. IEEE International Symposium, Jul. 11, 2008.
Blanch, S. et al, Exact representation of antenna system diversity performance from input parameter description, Electronics Letters, May 1, 2003.
Chaudhury Kabir, S.; Schoeder, W.; Chaloupka, H., Multiple antenna concept based on characteristic modes of mobiles phone chassis, Antennas and Propagation (EUCAP), 2nd, 2007. European Conference on, Nov. 11, 2007.
Andujar, A. Ground plane booster antenna technology. European Conference on Antennas and Propagation, 2012.
Anguera, J. et al. Enhancing the performance of handset antennas by means of groundplane design. Antenna Technology Small Antennas and Novel Metamaterials, 2006 IEEE International Workshop on. Mar. 2006.
Anguera, J. et al. Multiband handset antenna by means of groundplane modification. IEEE International Symposium on Antennas and Propagation. "2007 IEEE Antennas and Propagation Society international symposium: Honolulu, HI, Jun. 9-15, 2007". San Diego: Institute of Electrical and Electronics Engineers (IEEE), 2007, p. 1253-1256.
Kim, B. N. et al. Hexaband planar inverted-F antenna with novel feed structure for wireless terminals. IEEE Antennas and Wireless Propagation Letters. vol. 6. 2007.
Hossa, R. Improvement of compact terminal antenna performance by incorporating open-end slots in ground plane. IEEE Microwave and Wireless Components Letters. vol. 14 No. 6. Jun. 2004.
Rahola, J., Estimating antenna bandwidth using the bandwidth potential and Q value techniques, Optenni, Nov. 23, 2010.
Li, H.; Tan, Y.; Lau, B. K.; Ying, Z.; He, S., Characteristic mode based tradeoff analysis of antenna-chassis interactions for multiple antenna, Antennas and Propagation, IEEE Transactions on, vol. 60, No. 2, Feb. 1, 2012.
Matching circuit optimization for antenna applications, CST AG, Jan. 1, 2012.
"Multi-Band Combining", "How isolation helps duplex communications overcome both challenges" on Understanding the RF Path, Commscope, 2012, p. 41-45, 67-68.

* cited by examiner

CONCENTRATED WIRELESS DEVICE PROVIDING OPERABILITY IN MULTIPLE FREQUENCY REGIONS

CROSS REFERENCE TO RELATED APPLICATIONS

This application is a divisional of U.S. patent application Ser. No. 15/163,469 filed May 24, 2016, which is a continuation of U.S. patent application Ser. No. 13/803,100 filed Mar. 14, 2013, which claims priority under 35 U.S.C. § 119(e) from U.S. Provisional Patent Application Ser. No. 61/671,906, filed Jul. 16, 2012, and entitled "Concentrated Antennaless Wireless Device Providing Operability in Multiple Frequency Regions," the entire contents of which are hereby incorporated by reference.

TECHNICAL FIELD

The present invention relates to the field of multiband wireless devices, and generally to wireless devices which require the transmission and reception of electromagnetic wave signals.

BACKGROUND

Wireless devices typically operate in one or more cellular communication standards and/or wireless connectivity standards, each standard being allocated in one or more frequency bands, and said frequency bands being contained within one or more regions of the electromagnetic spectrum.

For that purpose, a space within the wireless handheld or portable device is usually dedicated to the integration of a radiating system. The radiating system is, however, expected to be small in order to occupy as little space as possible within the device, which then allows for smaller devices, or for the addition of more specific equipment and functionality into the device.

This is even more critical in the case in which the wireless device is a multifunctional wireless device. Commonly-owned patent applications WO2008/009391 and US2008/0018543 describe a multifunctional wireless device. The entire disclosure of said application numbers WO2008/009391 and US2008/0018543 are hereby incorporated by reference.

A typical wireless device must include a radiating system capable of operating in one or more frequency regions with good radio-electric performance (such as for example in terms of input impedance level, impedance bandwidth, gain, efficiency, or radiation pattern). Moreover, the possibility to operate in several frequency regions allows global connectivity, increased connectivity speeds, or multiple functionalities.

For a good wireless connection, high gain and efficiency are further required. Other more common design demands for radiating systems are the voltage standing wave ratio (VSWR) and the impedance which is supposed to be about 50 ohms. Other demands for radiating systems for wireless handheld or portable devices are low cost and a low specific absorption rate (SAR).

A radiating system for a wireless device typically includes a radiating structure comprising an antenna element which operates in combination with a ground plane layer providing a determined radio-electric performance in one or more frequency regions of the electromagnetic spectrum. This is illustrated in FIG. 1, in which it is shown a radiating structure 100 comprising an antenna element 101 and a ground plane layer 102. Typically, the antenna element has a dimension close to an integer multiple of a quarter of the wavelength at a frequency of operation of the radiating structure, so that the antenna element is at resonance at said frequency and a radiation mode is excited on said antenna element.

A problem associated to the antenna element in a wireless device is that the volume dedicated for such integration has continuously shrunk with the appearance of new smaller and/or thinner form factors for wireless devices, and with the increasing convergence of different functionality in a same wireless device.

Some techniques to miniaturize and/or optimize the multiband behavior of an antenna element have been described in the prior art. However, the radiating structures therein described still rely on exciting a radiation mode on the antenna element.

For example, commonly-owned co-pending patent application US2007/0152886 describes a new family of antennas based on the geometry of space-filling curves. Also, commonly-owned co-pending patent application US2008/0042909 relates to a new family of antennas, referred to as multilevel antennas, formed by an electromagnetic grouping of similar geometrical elements. The entire disclosures of the aforesaid application numbers US2007/0152886 and US2008/0042909 are hereby incorporated by reference.

Some other attempts have focused on antenna elements not requiring a complex geometry while still providing some degree of miniaturization by using an antenna element that is not resonant in the one or more frequency ranges of operation of the wireless device.

For example, WO2007/128340 discloses a wireless portable device comprising a non-resonant antenna element for receiving broadcast signals (such as, for instance, DVB-H, DMB, T-DMB or FM). The wireless portable device further comprises a ground plane layer that is used in combination with said antenna element. Although the antenna element has a first resonance frequency above the frequency range of operation of the wireless device, the antenna element is still the main responsible for the radiation process and for the electromagnetic performance of the wireless device. This is clear from the fact that no radiation mode can be excited on the ground plane layer because the ground plane layer is electrically short at the frequencies of operation (i.e., its dimensions are much smaller than the wavelength).

With such limitations, while the performance of the wireless portable device may be sufficient for reception of electromagnetic wave signals (such as those of a broadcast service), the antenna element could not provide an adequate performance (for example, in terms of input return losses or gain) for a cellular communication standard requiring also the transmission of electromagnetic wave signals.

Commonly-owned patent application WO2008/119699 describes a wireless handheld or portable device comprising a radiating system capable of operating in two frequency regions. The radiating system comprises an antenna element having a resonance frequency outside said two frequency regions, and a ground plane layer. In this wireless device, while the ground plane layer contributes to enhance the electromagnetic performance of the radiating system in the two frequency regions of operation, it is still necessary to excite a radiation mode on the antenna element. In fact, the radiating system relies on the relationship between a resonance frequency of the antenna element and a resonance frequency of the ground plane layer in order for the radiating system to operate properly in said two frequency regions.

The entire disclosure of the aforesaid application number WO2008/119699 is hereby incorporated by reference.

Some further techniques to enhance the behavior of an antenna element relate to optimizing the geometry of a ground plane layer associated to said antenna element. For example, commonly-owned co-pending patent application U.S. Ser. No. 12/033,446 describes a new family of ground plane layers based on the geometry of multilevel structures and/or space-filling curves. The entire disclosure of the aforesaid application number U.S. Ser. No. 12/033,446 is hereby incorporated by reference.

In order to reduce as much as possible the volume occupied into the wireless handheld or portable device, recent trends in handset antenna design are oriented to maximize the contribution of the ground plane to the radiation process by using non-resonant elements.

Commonly owned patent applications, WO2010/015365 and WO2010/015364, the entire disclosures of which are hereby incorporated by reference, are intended for solving some of the aforementioned drawbacks. Namely, they describe a wireless handheld or portable device comprising a radiating system including a radiating structure and a radiofrequency system. The radiating structure is formed by a ground plane layer and at least one radiation booster. The radiation booster is not resonant in any of the frequency regions of operation and consequently a radiofrequency system is used to properly match the radiating structure to the desired frequency band/s of operation.

More particularly, in WO2010/015364 each radiation booster is intended for providing operation in a particular frequency region. Thus, the radiofrequency system is designed in such a way that the first internal port associated to the first radiation booster is highly isolated from the second internal port associated to a second radiation booster due to the distance in terms of wavelength between the internal ports of the radiating structure and therefore, between the radiation boosters.

Another technique is disclosed in U.S. Pat. No. 7,274,340, which shows a radiating system based on the use of two non-resonant elements providing impedance matching through the addition of two matching network systems. The two non-resonant elements are arranged in such a manner that they provide coupling to the ground plane. Despite the use of two non-resonant elements, the size of the element for the low band is significantly large, being 1/9.3 times the free-space wavelength of the lowest frequency for the low frequency band. Due to such size, the low band element would be a resonant element at the high band. The size of the low band element undesirably contributes to increase the printed circuit board (PCB) space required by the antenna module. In fact, such radiating system is still about the size of a conventional internal antenna inside a handset, therefore the overall radiating system does not provide a significant space advantage compared to the existing alternative solutions.

Therefore, a wireless device not requiring a large antenna element and only requiring a minimum area in the PCB would be advantageous as it would ease the integration of the radiating structure within the wireless device.

A wireless device that comprises a concentrated configuration of radiation booster/s, yet the wireless device featuring an adequate radio-electric performance in two or more frequency regions of the electromagnetic spectrum would be an advantageous solution. This problem is solved by a concentrated wireless device according to the present invention.

SUMMARY

It is an object of the present invention to provide a wireless device (such as for instance but not limited to a mobile phone, a smartphone, a tablet, an e-book, a navigator device, a PDA, an MP3 player, a portable video player, a headset, a USB dongle, a laptop computer, a netbook, a gaming device, a camera, a PCMCIA, or generally a multifunction wireless device) that operates in the desired frequency bands. Such a wireless device features a concentrated configuration (hereafter a concentrated wireless device) and operates in two or more frequency regions of the electromagnetic spectrum with improved radio-electric performance, increased robustness to the neighboring components of the concentrated wireless device, reduced required area for the radiating system of the concentrated wireless device, and increased flexibility to integrate other components and traces in the Printed Circuit Board (PCB).

Another object of the invention relates to a method to enable the operation of the concentrated wireless device featuring a concentrated configuration in two or more frequency regions of the electromagnetic spectrum with improved radio-electric performance, increased robustness to neighboring components of the concentrated wireless device, reduced required area for the radiating system of the concentrated wireless device, and increased flexibility to integrate other components and traces in the Printed Circuit Board (PCB).

An aspect of the present invention relates to the use of the ground plane layer of the radiating structure as an efficient radiator to provide an enhanced radio-electric performance in two or more frequency regions of operation of the concentrated wireless device, eliminating thus the need for an antenna element, and particularly the need for a multiband antenna element. Different radiation modes of the ground plane layer can be advantageously excited depending on the dimension of said ground plane layer.

Therefore, a wireless device not requiring a large antenna element would be advantageous as it would ease the integration of the radiating structure within the wireless device. The volume freed up by the absence of large antenna element would enable smaller and/or thinner devices, or even to adopt radically new form factors (such as for instance elastic, ultraslim, stretchable and/or foldable devices) which are not feasible today due to the presence of large antenna elements. Furthermore, by eliminating precisely the element that requires customization, a standard solution is obtained which only requires minor adjustments to be implemented in different wireless devices. By using a standard booster across multiple mobile device platforms enables reducing cost for the overall device, while speeding-up the design process and therefore reducing the time to market.

A concentrated wireless device featuring a concentrated solution according to the present invention is advantageous as it reduces the required area and it would increase the flexibility in arranging the elements on the PCB of said wireless device. That is, owing to the concentration of boosters in a small area, more space becomes available to integrate other components of the wireless device such as for example displays and batteries. Furthermore, by achieving a concentrated configuration, its integration in a wireless device is simplified since only a small portion of the wireless device volume is required to host the concentrated configuration.

A concentrated wireless device according to the present invention operates two, three, four or more cellular communication standards (such as for example LTE700, GSM 850, GSM 900, GSM 1800, GSM 1900, UMTS, HSDPA, CDMA, W-CDMA CDMA2000, TD-SCDMA, LTE2300, LTE2500, etc.), wireless connectivity standards (such as for instance WiFi, IEEE802.11 standards, Bluetooth, ZigBee, UWB, WiMAX, WiBro, or other high-speed standards), and/or broadcast standards (such as for instance FM, DAB, XDARS, SDARS, DVB-H, DMB, T-DMB, or other related digital or analog video and/or audio standards), each standard being allocated in one or more frequency bands, and said frequency bands being contained within two, three or more frequency regions of the electromagnetic spectrum.

In the context of this document, a frequency band refers to a range of frequencies used by a particular cellular communication standard, a wireless connectivity standard or a broadcast standard; while a frequency region refers to a continuum of frequencies of the electromagnetic spectrum. For example, the GSM 1800 standard is allocated in a frequency band from 1710 MHz to 1880 MHz while the GSM 1900 standard is allocated in a frequency band from 1850 MHz to 1990 MHz. A wireless device operating the GSM 1800 and the GSM 1900 standards must have a radiating system capable of operating in a frequency region from 1710 MHz to 1990 MHz. As another example, a wireless device operating the GSM 1800 standard and the UMTS standard (allocated in a frequency band from 1920 MHz to 2170 MHz), must have a radiating system capable of operating in two separate frequency regions.

A concentrated wireless device according to the present invention may have a candy-bar shape, which means that its configuration is given by a single body. It may also have a two-body configuration such as a clamshell, flip-type, swivel-type or slider structure. In some other cases, the device may have a configuration comprising three or more bodies. It may further or additionally have a twist configuration in which a body portion (e.g. with a screen) can be twisted (i.e., rotated around two or more axes of rotation which are preferably not parallel). Also, the present invention makes it possible for radically new form factors, such as for example devices made of elastic, stretchable and/or foldable materials.

In accordance with the present invention, the communication module of the concentrated wireless device includes a radiating system capable of transmitting and receiving electromagnetic wave signals in at least two frequency regions of the electromagnetic spectrum: a first frequency region and a second frequency region, wherein preferably the highest frequency of the first frequency region is lower than the lowest frequency of the second frequency region. Said radiating system comprises a radiating structure comprising: at least one ground plane layer capable of supporting at least one radiation mode, the at least one ground plane layer including at least one connection point; at least one radiation booster to couple electromagnetic energy from/to the at least one ground plane layer, the/each radiation booster including a connection point; and at least one internal port. The/each internal port is defined between the connection point of the/each radiation booster and one of the at least one connection points of the at least one ground plane layer. The radiating system of the concentrated wireless device further comprises a radiofrequency system, and at least one external port.

A main feature of the radiating system of the present invention is that the operation in at least two frequency regions of operation is achieved by one radiation booster, or by at least two radiation boosters, or by at least one radiation booster and at least one antenna element, in all cases occupying a small area of the ground plane layer. Said radiofrequency system comprises at least one port connected to each of the at least one internal ports of the radiating structure (i.e. as many ports as there are internal ports of the radiating structure), and at least another port connected to the at least one external port of the radiating system. Said radiofrequency system modifies the impedance of the radiating structure, providing impedance matching to the radiating system in the at least two frequency regions of operation of the radiating system.

In this text, a port of the radiating structure is referred to as an internal port; while a port of the radiating system is referred to as an external port. In this context, the terms "internal" and "external" when referring to a port are used simply to distinguish a port of the radiating structure from a port of the radiating system, and carry no implication as to whether a port is accessible from the outside or not.

The ground plane layer may be shaped substantially as a rectangle, square, triangle, circle, or alike. It may also have more than one body arranged in different positions, like in a clamshell or laptop configuration, or it may comprise more than one layer as in a multi-layer PCB.

A ground plane rectangle is defined as being the minimum-sized rectangle that encompasses a ground plane layer of the radiating structure. That is, the ground plane rectangle is a rectangle whose sides are tangent to at least one point of said ground plane layer.

In some cases, the ratio between a side of the ground plane rectangle, preferably a long side of the ground plane rectangle, and the free-space wavelength corresponding to the lowest frequency of the first frequency region, is advantageously larger than a minimum ratio. Some possible minimum ratios are 0.1, 0.16, 0.2, 0.3, 0.4, 0.5, 0.6, 0.8, 1, 1.2 and 1.4. Said ratio may additionally be smaller than a maximum ratio (i.e., said ratio may be larger than a minimum ratio but smaller than a maximum ratio). Some possible maximum ratios are 0.4, 0.5, 0.6, 0.8, 1, 1.2, 1.4, 1.6, 2, 3, 4, 5, or 10.

According to the present invention, setting a dimension of the ground plane rectangle, preferably the dimension of its long side, relative to said free-space wavelength within these ranges makes it possible for the ground plane layer to support one, two, three or more efficient radiation modes, in which the currents flowing on the ground plane layer are substantially aligned and contribute in phase to the radiation process.

The/each radiation booster advantageously couples the electromagnetic energy from the radiofrequency system to the ground plane layer in transmission, and from the ground plane layer to the radiofrequency system in reception. Thereby the radiation booster boosts the radiation or reception of electromagnetic radiation.

The maximum size of a radiation booster is preferably defined by the largest dimension of a booster box that completely encloses said radiation booster, and in which the radiation booster is inscribed.

In some examples, the/each radiation booster has a maximum size smaller than $1/30$, $1/40$, $1/50$, $1/60$, $1/80$, $1/100$, $1/140$ or even $1/180$ times the free-space wavelength corresponding to the lowest frequency of the first frequency region of operation of the concentrated wireless device.

In some further examples, at least one (such as for instance, one, two, three or more) radiation booster has a maximum size smaller than $1/30$, $1/40$, $1/50$, $1/60$, $1/80$, $1/100$, $1/140$ or even $1/180$ times the free-space wavelength corresponding to the lowest frequency of the second frequency region of operation of said device.

Additionally, in some of these examples the/each radiation booster has a maximum size larger than 1/1400, 1/700, 1/350, 1/250, 1/180, 1/140 or 1/120 times the free-space wavelength corresponding to the lowest frequency of said first frequency region. Therefore, in some examples the/each radiation booster has a maximum size advantageously smaller than a first fraction of the free-space wavelength corresponding to the lowest frequency of the first frequency region but larger than a second fraction of said free-space wavelength.

Furthermore, in some of these examples, at least one, two, or three radiation boosters have a maximum size larger than 1/1400, 1/700, 1/350, 1/175, 1/120, or 1/90 times the free-space wavelength corresponding to the lowest frequency of the second frequency region of operation of the concentrated wireless device.

In some embodiments in which the radiating structure comprises more than one radiation booster, a different booster box is defined for each of them.

The radiation boosters behave as non-resonant elements at the first and second frequency regions, so that the radiating structure has at the internal port, when disconnected from the radiofrequency system, a first resonance frequency at a frequency much higher than the frequencies of the first and second frequency regions of operation.

In some examples, for at least some of, or even all, the internal ports of the radiating structure, the ratio between the first resonance frequency at a given internal port of the radiating structure when disconnected from the radiofrequency system and the highest frequency of said first frequency region is preferably larger than a certain minimum ratio. Some possible minimum ratios are 3.0, 3.4, 3.8, 4.0, 4.2, 4.4, 4.6, 4.8, 5.0, 5.2, 5.4, 5.6, 5.8, 6.0, 6.2, 6.6 or 7.0.

In the context of this document, a resonance frequency associated to an internal port of the radiating structure preferably refers to a frequency at which the input impedance measured at said internal port of the radiating structure, when disconnected from the radiofrequency system, has an imaginary part equal to zero.

The radiation boosters may have a volumetric or even a planar structure. In a preferred embodiment, the at least one radiation booster comprises a conductive part. In some cases said conductive part may take the form of, for instance but not limited to, a conducting strip comprising one or more segments, a polygonal shape (including for instance triangles, squares, rectangles, quadrilaterals, pentagons, hexagons, octagons, or even circles or ellipses as limit cases of polygons with a large number of edges), a polyhedral shape comprising a plurality of faces (including also cylinders or spheres as limit cases of polyhedrons with a large number of faces), or a combination thereof.

Some examples of radiation boosters comprises at least two conducting parts (shaped as planar structures, volumetric structures, or alike) connected to each other by ohmic contact, by electromagnetic coupling, by a conducting trace or by at least one lumped circuit element.

In another preferred example, the at least one radiation booster comprises a gap (i.e., absence of conducting material) defined in the ground plane layer. Said gap is delimited by one or more segments defining a curve. A connection point of the radiation booster is preferably located at a first point along said curve. A connection point of the ground plane layer is preferably located at a second point along said curve, said second point being different from said first point.

In yet another preferred example, a radiating structure includes a first radiation booster comprising a conductive part and a second radiation booster comprising a gap defined in the ground plane layer.

In some embodiments, the at least one radiation booster is substantially coplanar to the ground plane layer. Furthermore, in some cases the at least one radiation booster is advantageously embedded in the same PCB as the one containing the ground plane layer, which results in a radiating structure having a compact and low profile.

The at least one radiation booster may be located in different parts of the radiating structure. In some examples, at least one, two, three, or even all, radiation boosters are preferably located substantially close to an edge of the ground plane layer, preferably said edge being in common with a side of the ground plane rectangle. In some examples, at least one radiation booster is more preferably located substantially close to an end of said edge or to the middle point of said edge.

In an example, a radiation booster is located preferably substantially close to a short side of the ground plane rectangle, and more preferably substantially close to an end of said short side or to the middle point of said short side.

In another example, a radiation booster is located preferably substantially close to a long side of the ground plane rectangle, and more preferably substantially close to an end of said long side or to the middle point of said long side.

In a preferred example the radiating structure is arranged within the concentrated wireless device in such a manner that there is no ground plane in the orthogonal projection of a radiation booster onto the plane containing the ground plane layer. In some examples there is some overlapping between the projection of a radiation booster and the ground plane layer. In some embodiments less than a 10%, a 20%, a 30%, a 40%, a 50%, a 60% or even a 70% of the area of the projection of a radiation booster overlaps the ground plane layer. Yet in some other examples, the projection of a radiation booster onto the ground plane layer completely overlaps the ground plane layer.

In some cases it is advantageous to protrude at least a portion of the orthogonal projection of a radiation booster beyond the ground plane layer, or alternatively remove ground plane from at least a portion of the projection of a radiation booster, in order to adjust the levels of impedance and to enhance the impedance bandwidth of the radiating structure.

A radiating system of a concentrated wireless device is achieved when the radiating structure comprises one radiation booster, at least two radiation boosters close to each other, or at least one radiation booster and at least one antenna element close to each other; always occupying a small area when compared to the overall dimensions of the radiating system. This is clearly and advantage because a concentrated configuration allows the radiofrequency system to be located nearby the internal port/s and therefore, simplify the PCB layout, reducing the distance between RF components, thus minimizing losses due to transmission lines and interconnection conductors compared with a solution where there is a substantial spread-out of boosters on the PCB.

For a radiating structure comprising more than one radiation booster, the concentrated configuration comprises radiation boosters that are substantially very close to each other in terms of the operating wavelength. Furthermore, since the radiation boosters are very small in terms of the operating wavelength, each internal port of the radiating structure is also substantially very close to each other in terms of the operating wavelength.

In another preferred embodiment, the radiating structure of the concentrated wireless device comprises at least one radiation booster and at least one antenna element. The distance between each internal port of the radiating structure is very small in terms of the operating wavelength.

The antenna element can be an antenna operating in at least one frequency region and it can be shaped as all the known topologies, such as a PIFA, IFA, monopole, patch, loop, or alike. Typically, the antenna element has a dimension close to an integer multiple of a quarter of the wavelength at a frequency of operation of the radiating structure, so that the antenna element is at resonance or substantially close to resonance at said frequency and a radiation mode is excited on said antenna element. Therefore, the size of the antenna element is usually much bigger than a radiation booster, which features very small dimensions in terms of the operating wavelength.

In an embodiment comprising a single radiation booster, the radiofrequency system further comprises an impedance equalizer circuit. Since the impedance of the radiating structure at the internal port of said radiating structure, when disconnected from the radiofrequency system, has an important reactive (either capacitive or inductive) impedance at the first and second frequency region of operation, in order to achieve a good radio-electric performance in more than one frequency region it is advantageous to include an impedance equalizer together with additional stages of the radiofrequency system.

An objective of the impedance equalizer circuit is to substantially equalize the input impedance of the radiating structure at its internal port in at least the first and second frequency region in order to simplify the matching network of the radiofrequency system and therefore, achieve at least two frequency regions of operation. If the impedance equalizer is not included, the number of components of a matching network of the radiofrequency system used to match the radiating structure to at least two frequency regions of operation might become very large. Having a large number of components results in additional losses for the radiating system and its response becomes more sensitive to tolerances of the components. These problems are solved for instance by means of the impedance equalizer described in this invention.

The impedance equalizer circuit of the present invention is designed as to compensate the imaginary part of the input impedance of the radiating structure at the internal port when disconnected from the radiofrequency system for a frequency out of the first and second frequency region. In this way, the input impedance, after the impedance equalizer circuit has been included, features an imaginary part substantially close to zero for a frequency preferably between the highest frequency of the first frequency region of operation and the lowest frequency of the second frequency region of operation. Furthermore, in some embodiments the imaginary part of the input impedance after the impedance equalizer circuit within the first frequency region is substantially the complex conjugate of the imaginary part of the input impedance within the second frequency region. For example, the complex conjugate can be achieved when the first frequency region presents a capacitive behavior, and the second frequency region presents an inductive behavior while both regions present a substantially similar real part of input impedance, or vice versa, that is, the first frequency region presents an inductive behavior, and the second frequency region presents a capacitive behavior while both regions present a substantially similar real part of input impedance. A substantially similar value of the real part of the input impedance between the first and second frequency regions may accept variations of 5, 10, 20, 30, or even 50Ω. Moreover, the modulus of the imaginary part of the input impedance presents similar values within the first and second frequency regions, although small variations of less than 10, less than 20, less than 35, or less than 50Ω are used in some embodiments.

In some examples of the present invention, the impedance equalizer circuit has one stage that comprises one lumped element (inductor, capacitor, and resistor), two lumped elements connected in series or parallel, or a combination of both. In some other cases, the impedance equalizer circuit has more than one stage comprising the aforementioned elements or combination of elements, and in some other cases it also comprises at least one transmission or delay line.

A preferred example of the present invention is formed by a radiating system comprising one radiating structure, said radiating structure having one ground plane layer, one radiation booster and one radiofrequency system. The radiofrequency system of said preferred example comprises at least an impedance equalizer circuit and at least one matching network.

In another preferred example of the present invention, the radiating system comprises one radiating structure, the radiating structure having one ground plane layer, one radiation booster and one radiofrequency system. Said radiofrequency system comprises at least one impedance equalizer, at least one filtering circuit connected to the at least one impedance equalizer and at least two matching networks.

In some examples, the radiofrequency system has at least two outputs and therefore, at least two external ports, where each external port provides operation in each frequency region of operation. In a further example, all the outputs are joined together by means of a combiner or a diplexer so as the radiofrequency system has a single external port providing operation in at least two frequency regions of the electromagnetic spectrum.

A combiner or a diplexer can comprise a bank of filters and/or transmission lines. Preferably, there are as many filters in the bank of filters or transmission lines as there are frequency regions of operation of the radiating system. Each one of the filters or transmission lines is designed to introduce low insertion loss within a corresponding frequency region and to present high impedance to the combiner within other frequency regions. The combiner combines the electrical signals of different frequency regions of operation of the radiating system.

In the context of this document high impedance in a given frequency region preferably refers to impedance having a modulus not smaller than 150 Ohms, 200 Ohms, 300 Ohms, 500 Ohms or even 1000 Ohms for any frequency within said frequency region, and more preferably being substantially reactive (i.e., having a real part substantially close to zero) within said given frequency region.

When more than one radiation booster is used, the maximum distance between radiation boosters is preferably defined by the shortest distance between the internal ports.

In some embodiments, the maximum distance between internal ports is 0.06 times the free-space wavelength corresponding to the lowest frequency of the first frequency region of operation of the concentrated wireless device, although in some examples, the distance is less than 0.02, 0.01, or even 0.005 times the free-space wavelength corresponding to the lowest frequency of the first frequency region of operation of the concentrated wireless device. In a preferred example, the distance is less than 0.006 times the free-space wavelength corresponding to the lowest frequency of the first frequency region of operation of the concentrated wireless device.

In an embodiments where the concentrated wireless device comprises one antenna element and at least one radiation booster, the maximum distance between their internal ports is less than 0.06 times the free-space wavelength corresponding to the lowest frequency of the first frequency region of operation of the concentrated wireless device. In some examples, the distance is less than 0.02, 0.01, or 0.005 times the free-space wavelength corresponding to the lowest frequency of the first frequency region of operation of the concentrated wireless device.

An advantage of the radiating system for a concentrated wireless device having radiation boosters is its configuration because it only occupies a small area of the wireless device and it does not require complex PCB designs.

For a concentrated configuration, however, one of the main problems is the mutual coupling between radiation boosters or between one radiation booster and one antenna element. Due to their close position, one radiation booster degrades the radio-electric performance of the other, and vice versa. In the same manner, in those cases comprising one radiation booster and one antenna element, the presence of the radiation booster degrades the radio-electric performance of the antenna element, and vice versa.

One object of the present invention is to provide solutions to minimize the coupling between radiation boosters or between radiation boosters and antenna elements, taking into account the concentrated configuration according to the present invention.

In order to minimize the coupling between radiation boosters and therefore maximize their radio-electric performance, a filtering circuit is added to the radiofrequency system. The same applies for those concentrated configuration comprising radiation booster/s and antenna element/s.

The main function of the filtering circuit is to isolate each radiation booster from the other/s (radiation boosters or antenna elements) at each frequency region of operation. In some examples, the radiation booster in charge of the first frequency region needs a filtering circuit in its internal port acting as a notch at the second frequency region. In other examples, the radiation booster in charge of the second frequency region needs a filtering circuit in its internal port acting as a notch at the first frequency region. Furthermore, some other examples need a filtering circuit in each internal port of the radiating structure. In other examples, the radiation booster and the antenna element need a filtering circuit in each internal port.

The filtering circuit usually comprises at least one lumped element like an inductor, a capacitor or a combination of both. In some examples, it is achieved by groups of two lumped elements arranged either in parallel or in series. There are other types of filtering circuits that comprise active circuits, switches, diodes, or even programmable chipsets. Each filtering circuit is designed to introduce low insertion loss in one frequency region and to present high impedance in the other/s frequency region/s.

In some embodiments, the radiofrequency system comprises at least one matching network (such as for instance, one, two, three, four or more matching networks) to transform the input impedance of the radiating structure, providing impedance matching to the radiating system in at least the first and second frequency regions of operation of the radiating system.

In a preferred example, the radiofrequency system comprises as many matching networks or stages of a matching network as there are radiation boosters (and consequently, internal ports) in the radiating structure.

In another preferred example, the radiofrequency system comprises as many matching networks or stages of a matching network as there are frequency regions of operation of the radiating system. That is, in a radiating system operating for example in a first and in a second frequency region, its radiofrequency system may advantageously comprise a first matching network to provide impedance matching to the radiating system in said first frequency region and a second matching network to provide impedance matching to the radiating system in said second frequency region.

The/each matching network can comprise a single stage or a plurality of stages. In some examples, the/each matching network comprises at least two, at least three, at least four, at least five, at least six, at least seven, at least eight or more stages.

A stage comprises one or more circuit components (such as for example but not limited to inductors, capacitors, resistors, jumpers, short-circuits, switches, delay lines, resonators, or other reactive or resistive components). In some cases, a stage has a substantially inductive behavior in the frequency regions of operation of the radiating system, while another stage has a substantially capacitive behavior in said frequency regions, and yet a third one may have a substantially resistive behavior in said frequency regions.

A stage can be connected in series or in parallel to other stages and/or to one of the at least one port of the radiofrequency system.

In some examples, the at least one matching network alternates stages connected in series (i.e., cascaded) with stages connected in parallel (i.e., shunted), forming a ladder structure. In some cases, a matching network comprising two stages forms an L-shaped structure (i.e., series—parallel or parallel—series). In some other cases, a matching network comprising three stages forms either a pi-shaped structure (i.e., parallel—series—parallel) or a T-shaped structure (i.e., series—parallel—series).

In some examples, the at least one matching network alternates stages having a substantially inductive behavior, with stages having a substantially capacitive behavior.

In an example, a stage may substantially behave as a resonant circuit (such as, for instance, a parallel LC resonant circuit or a series LC resonant circuit) in at least one frequency region of operation of the radiating system (such as for instance in the first or the second frequency region). The use of stages having a resonant circuit behavior allows one part of a given matching network be effectively connected to another part of said matching network for a given range of frequencies, or in a given frequency region, and be effectively disabled for another range of frequencies, or in another frequency region.

In an example, the at least one matching network comprises at least one active circuit component (such as for instance, but not limited to, a transistor, a diode, a MEMS device, a relay, or an amplifier) in at least one stage.

In some embodiments, the/each matching network preferably includes a reactance cancellation circuit comprising one or more stages, with one of said one or more stages being connected to a port of the radiofrequency system, said port being for interconnection with an internal port of the radiating structure.

In the context of this document, reactance cancellation preferably refers to compensating the imaginary part of the input impedance at an internal port of the radiating structure when disconnected from the radiofrequency system so that the input impedance of the radiating system at an external port has an imaginary part substantially close to zero for a frequency preferably within a frequency region of operation (such as for instance, the first or the second frequency regions). In some less preferred examples, said frequency may also be higher than the highest frequency of said frequency region (although preferably not higher than 1.1, 1.2, 1.3 or 1.4 times said highest frequency) or lower than the lowest frequency of said frequency region (although preferably not lower than 0.9, 0.8 or 0.7 times said lowest frequency). Moreover, the imaginary part of an impedance is considered to be substantially close to zero if it is not larger (in absolute value) than 15 Ohms, and preferably not larger than 10 Ohms, and more preferably not larger than 5 Ohms.

In a preferred embodiment, the radiating structure features at a first internal port, when the radiofrequency system is disconnected from said first internal port, an input impedance having a capacitive component for the frequencies of the first and second frequency regions of operation. In that embodiment, a matching network interconnected to said first internal port (via a port of the radiofrequency system) includes a reactance cancellation circuit that comprises a first stage having a substantially inductive behavior for all the frequencies of the first and second frequency regions of operation of the radiating system. More preferably, said first stage comprises an inductor. In some cases, said inductor may be a lumped inductor. Said first stage is advantageously connected in series with said port of the radiofrequency system that is interconnected to said first internal port of the radiating structure of a radiating system.

In another preferred embodiment, the radiating structure features at a first internal port, when the radiofrequency system is disconnected from said first internal port, an input impedance having an inductive component for the frequencies of the first and second frequency regions of operation. In that embodiment, a matching network interconnected to said first internal port (via a port of the radiofrequency system) includes a reactance cancellation circuit that comprises a first stage having a substantially capacitive behavior for all the frequencies of the first and second frequency regions of operation of the radiating system. More preferably, said first stage comprises a capacitor. In some cases, said capacitor may be a lumped capacitor. Said first stage is advantageously connected in series with said port of the radiofrequency system that is interconnected to said first internal port of the radiating structure of a radiating system.

In some embodiments, the at least one matching network may further comprise a broadband matching circuit, said broadband matching circuit being preferably connected in cascade to the reactance cancellation circuit. With a broadband matching circuit, the impedance bandwidth of the radiating structure may be advantageously increased. This may be particularly interesting for those cases in which the relative bandwidth of the first and/or second frequency region is large, for example, more than one frequency band is contained within the first and/or second frequency region.

In a preferred embodiment, the broadband matching circuit comprises a stage that substantially behaves as a resonant circuit (preferably as a parallel LC resonant circuit or as a series LC resonant circuit) in one of the at least two frequency regions of operation of the radiating system.

In some examples, the at least one matching network may further comprise in addition to the reactance cancellation circuit and/or the broadband matching circuit, a fine tuning circuit to correct small deviations of the input impedance of the radiating system with respect to some given target specifications.

In a preferred example, a matching network comprises: a reactance cancellation circuit connected to a first port of the radiofrequency system, said first port being connected to an internal port of the radiating structure; and a fine tuning circuit connected to a second port of the radiofrequency system, said second port being connected to an external port of the radiating system. In an example, said matching network further comprises a broadband matching circuit operationally connected in cascade between the reactance cancellation circuit and the fine tuning circuit. In another example, said matching network does not comprise a broadband matching circuit and the reactance cancellation circuit is connected in cascade directly to the fine tuning circuit.

In some examples, at least some circuit components in the stages of the at least one matching network are discrete lumped components (such as for instance SMT components), while in some other examples all the circuit components of the at least one matching network are discrete lumped components. In some examples, at least some circuit components in the stages of the at least one matching network are distributed components (such as for instance a transmission line printed or embedded in a PCB containing the ground plane layer of the radiating structure), while in some other examples all the circuit components of the at least one matching network are distributed components.

In some examples, at least some, or even all, circuit components in the stages of the at least one matching network may be integrated into an integrated circuit, such as for instance a CMOS integrated circuit or a hybrid integrated circuit.

In some examples, one, two, three or even all the stages of the radiofrequency system may contribute to more than one functionality of said at least one matching network, impedance equalizer circuit, or filtering circuit. A given stage may for instance contribute to two or more of the following functionalities from the group comprising: reactance cancellation, impedance transformation (preferably, transformation of the real part of said impedance), broadband matching, fine tuning matching, impedance equalizer, filtering, or combiner. Using a same stage of the at least one matching network for several purposes may be advantageous in reducing the number of stages and/or circuit components required for the radiofrequency system, reducing the real estate requirements on the PCB of the concentrated wireless device in which the radiating system is integrated.

It is also important to notice that some stages of the radiofrequency system may be located after or before other stages depending on the radiating structure, the frequency regions of operation, or their particular functionality, which means that there is not a compulsory order for the stages of a radiofrequency system. In some examples, the filtering circuit or impedance equalizer circuit may be the first stage of the radiofrequency system, while in other examples, the filtering circuit or impedance equalizer circuit may be located between the first and second stage of the matching network.

One preferred example of the present invention comprises a radiating system having one radiating structure and a radiofrequency system, and said radiating structure having a ground plane layer and two radiation boosters in a concentrated configuration. Concretely, both radiation boosters are aligned in the same axis as the shortest edge of the ground plane and separated by less than 0.06 times the free-space wavelength corresponding to the lowest frequency of the first frequency region of operation of the concentrated wireless device. Said radiofrequency system comprises two ports connected respectively to the first and second internal ports of the radiating structure and a third port connected to the external port of the radiating system. The radiofrequency system also comprises a first filtering circuit and a matching network connected to the first internal port of the radiating structure, providing impedance matching within the first frequency region. The radiofrequency system also comprises a second filtering circuit and a matching network connected to the second internal port of the radiating structure, providing impedance matching within the second frequency region.

The radiofrequency system additionally includes a combiner or diplexer to combine the electrical signals of different frequency regions. Said combiner or diplexer is connected to the external port of the radiating system.

In a preferred example, said filtering circuit comprises a series circuit comprising a LC resonant circuit comprising an inductor and a capacitor connected in parallel. One port of the filtering circuit is connected to an internal port of the radiating structure and the other port of the filtering circuit is connected to another port of another stage of the radiofrequency system. In a preferred example, the next stage is a matching network. The main feature of this filtering circuit is that it presents high impedance at one frequency region while presenting low insertion loss at the other frequency region. Preferably, the resonant frequency of said resonant circuit is located within one of said frequency regions. Said matching network connected in cascade with the filtering circuit comprises a reactance cancellation achieved by a series inductor and a broadband matching network. In yet another cases, said matching network further comprises a fine-tuning circuit.

In some other preferred examples, the reactance cancellation circuit apart from compensating the imaginary part of the input impedance at an internal port of the radiating structure when disconnected from the radiofrequency system, it also functions as a filtering circuit as it presents high impedance in one frequency region and low insertion loss in the other.

In yet another preferred examples, said matching network connected in cascade with the filtering circuit comprises a reactance cancellation achieved by a series capacitor and a broadband matching network.

In some preferred examples, the radiating structure comprises at least one radiation booster, or at least two radiation boosters in a concentrated configuration, or at least one radiation booster and an antenna element in a concentrated configuration, and a ground plane layer having at least one slot. Said slot having a substantially elongated shape defined by its length and width and distance to an internal port of the radiating structure.

The length of said slot is preferably less than $1/4$, or preferably less than $1/8$, $1/10$, or $1/20$ times the free-space wavelength corresponding to the lowest frequency of the first frequency region of operation of the concentrated wireless device. Furthermore, the length of said slot is preferably larger than $1/70$, $1/50$, $1/40$, or even $1/30$ times the free-space wavelength corresponding to the lowest frequency of the first frequency region of operation of the concentrated wireless device.

The width of said slot is preferably less than $1/10$, $1/20$, $1/25$, and preferably larger than $1/4000$, $1/200$, $1/1000$, $1/500$, or even $1/100$ times the free-space wavelength corresponding to the lowest frequency of the first frequency region of operation of the concentrated wireless device.

The distance between said slot and an internal port of the radiating structure is preferably less than $1/10$ times the free-space wavelength corresponding to the lowest frequency of the first frequency region of operation of the concentrated wireless device.

In other examples, the distance between said slot and an internal port of the radiating structure may be larger than $1/10$ times the free-space wavelength corresponding to the lowest frequency of the first frequency region of operation of the concentrated wireless device.

Basically, the slot in the ground plane is optimized in terms of length, width and distance to the internal port of the radiating structure because its main objective is to provide better radio-electric performance and/or simplify the components and/or stages of the radiofrequency system.

In some examples, the radiating structure comprises one radiation booster and at least one slot in the ground plane layer, which helps to enhance the bandwidth in at least one frequency region.

In other examples, the radiating structure comprises one radiation booster and at least one slot in the ground plane layer, which helps to introduce at least one frequency band or even at least one frequency region.

In the context of the present invention, it is possible to have a radiating structure that comprises more than one radiation booster and at least one slot in the ground plane layer substantially close to both radiation boosters with the aim to achieve better isolation between their internal ports. In some embodiments said slot is placed in the area within two radiation boosters.

In yet other examples, the radiating structure comprises more than one radiation booster and at least one slot in the ground plane layer, which helps to enhance the bandwidth in at least one frequency region.

Furthermore, in some examples, the ground plane layer of a radiating system of a concentrated wireless device according to the present invention may comprise two, three, or more slots in the ground plane layer.

BRIEF DESCRIPTION OF THE DRAWINGS

Embodiments of the invention are shown in the enclosed figures. Herein shows.

DETAILED DESCRIPTION

Further characteristics and advantages of the invention will become apparent in view of the detailed description of some preferred embodiments which follows. Said detailed description of some preferred embodiments of the invention is given for purposes of illustration only and in no way is meant as a definition of the limits of the invention, made with reference to the accompanying figures.

Figure 1:
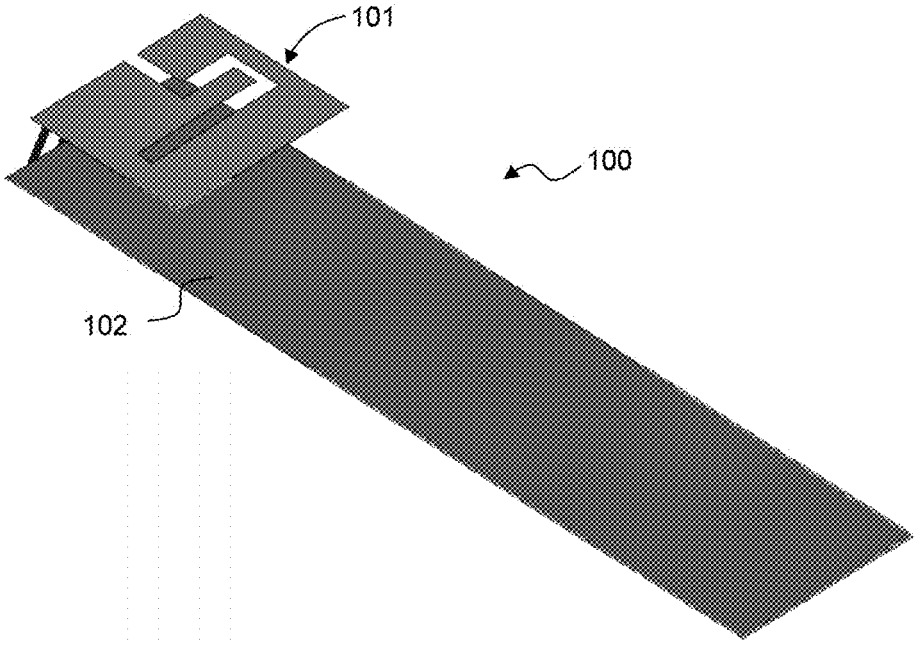
(PRIOR ART) Fig. 1
FIG. 1—Example of a radiating structure of the prior-art.

FIG. 1 shows a radiating structure 100 of the prior-art comprising an antenna element 101 and a ground plane layer 102. Typically, the antenna element has a dimension close to an integer multiple of a quarter of the wavelength at a frequency of operation of the radiating structure, so that the antenna element is at resonance or substantially close to resonance at said frequency and a radiation mode is excited on said antenna element.

Figure 2:
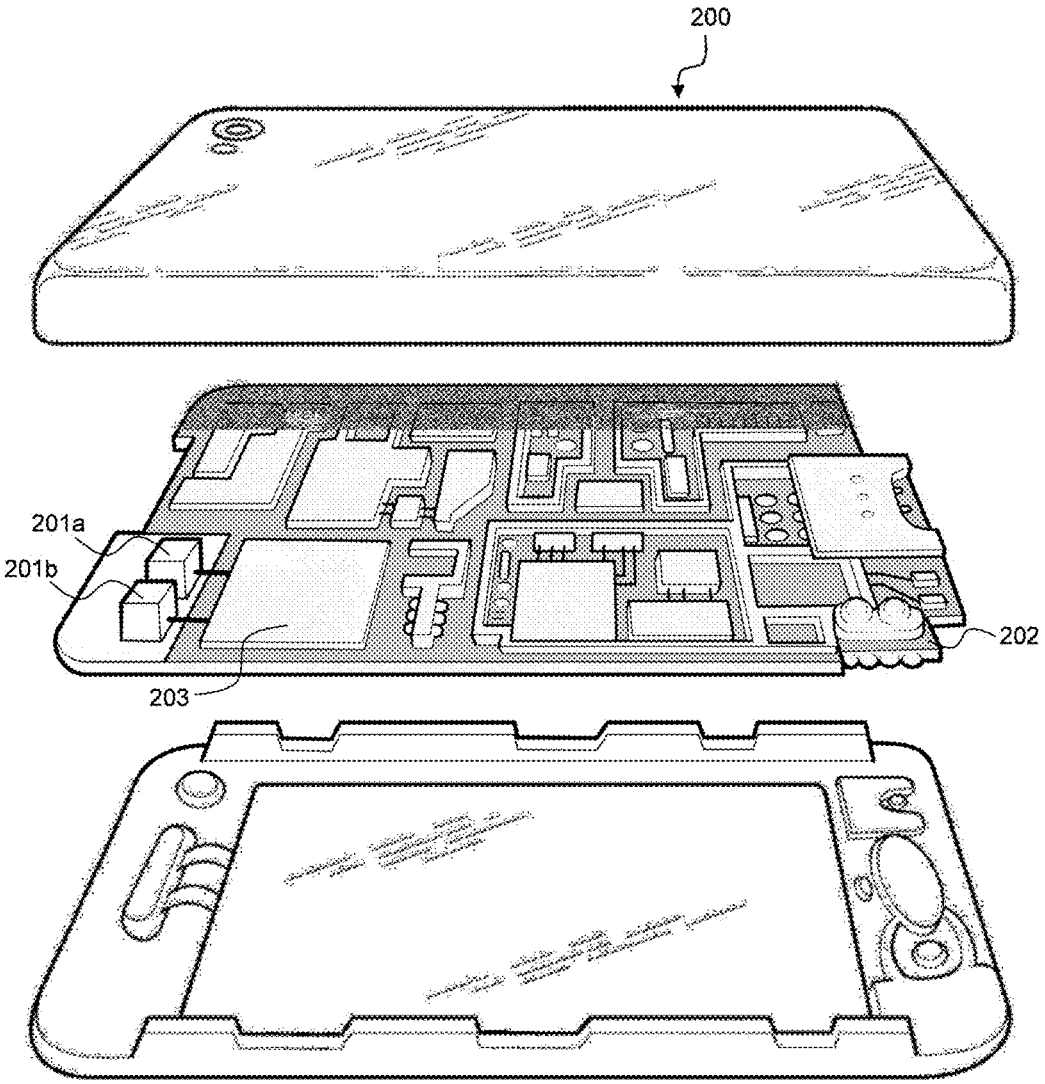
FIG. 2—Example of a concentrated wireless device according to the present invention.

FIG. 2 shows an illustrative example of a concentrated wireless device 200 capable of multiband operation according to the present invention comprising a radiating structure that includes a first radiation booster 201*a*, a second radiation booster 201*b* and a ground plane layer 202 (which could be included in a layer of a multilayer PCB). The concentrated wireless device 200 also comprises a radiofrequency system 203, which is interconnected with said radiating structure.

FIGS. 3*a*-3*d* show schematic representations of four examples of radiating systems for a concentrated wireless device capable of multiband operation according to the present invention.

Figure 3A:
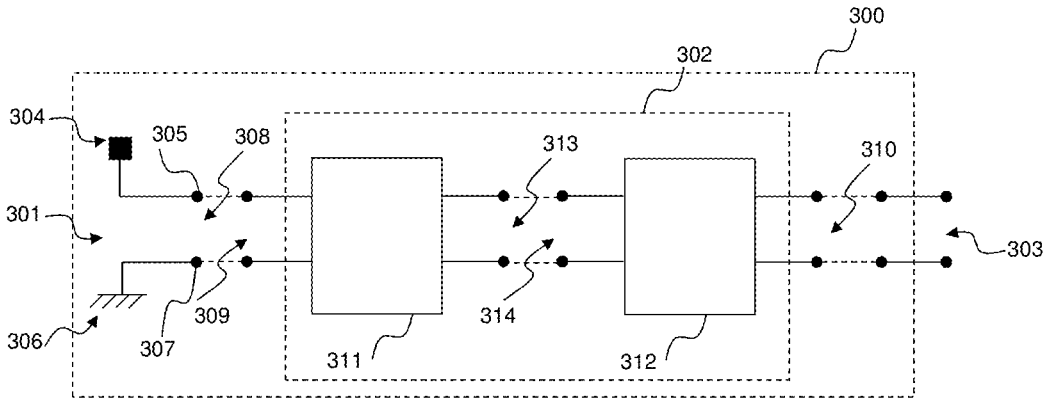
FIGS. 3*a*-3*d*—Schematic representations of 4 respective examples of radiating systems using one radiation booster according to the present invention.

In particular, in FIG. 3*a* a radiating system 300 comprises a radiating structure 301, a radiofrequency system 302, and an external port 303. The radiating structure 301 comprises a radiation booster 304, which includes a connection point 305, and a ground plane layer 306, said ground plane layer also including a connection point 307. The radiating structure 301 further comprises an internal port 308 defined between the connection point 305 of the radiation booster and the connection point 307 of the ground plane layer. Moreover, the radiofrequency system 302 comprises two ports: a first port 309 is connected to the internal port 308, and a second port 310 is connected to the external port 303 of the radiating system 300. Furthermore, the radiofrequency system 302 comprises an impedance equalizer circuit 311 and a matching network 312. The impedance equalizer circuit 311 comprises two ports: a first port 309 (which is the first port of the radiofrequency system 302) is connected to the internal port 308 of the radiating structure 301, and a second port 313 is connected to the first port 314 of the matching network 312. Regarding the matching network 312, it also comprises two ports: a first port 314 is connected to the second port 313 of the impedance equalizer circuit 311, and a second port 310 (which is the second port of the radiofrequency system 302) is connected to the external port 303 of the radiating system 300.

Figure 3B:
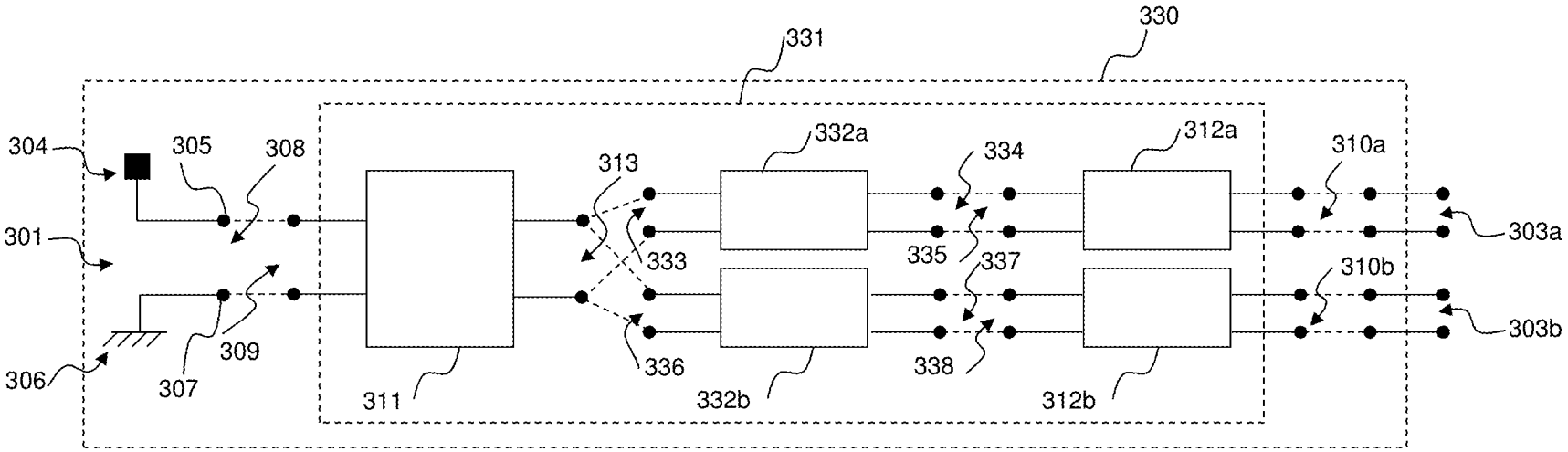

FIG. 3*b* shows a radiating system 330 comprising a radiating structure 301, a radiofrequency system 331, and two external ports 303*a* and 303*b*. The radiating structure 301 comprises a radiation booster 304, which includes a connection point 305, and a ground plane layer 306, said ground plane layer also including a connection point 307. The radiating structure 301 further comprises an internal port 308 defined between the connection point 305 of the radiation booster and the connection point 307 of the ground plane layer. Furthermore, the radiofrequency system 331 comprises an impedance equalizer circuit 311, two filtering circuits 332*a* and 332*b*, and two matching networks 312*a* and 312*b*.

The impedance equalizer circuit 311 comprises two ports: a first port 309 connected to the internal port 308 of the radiating structure 301, and a second port 313 connected to the first port 333 of a first filtering circuit 332*a* and to the first port 336 of a second filtering circuit 332*b*. The second ports 334 and 337 of the first and second filtering circuits 332*a* and 332*b* are connected to the first ports 335 and 338 of the first and second matching networks 312*a* and 312*b*, respectively. Finally, the second ports 310*a* and 310*b* of the first and second matching networks 312*a* and 312*b* are connected to the external ports 303*a* and 303*b*, respectively, of the radiating system 330.

Figure 3C:
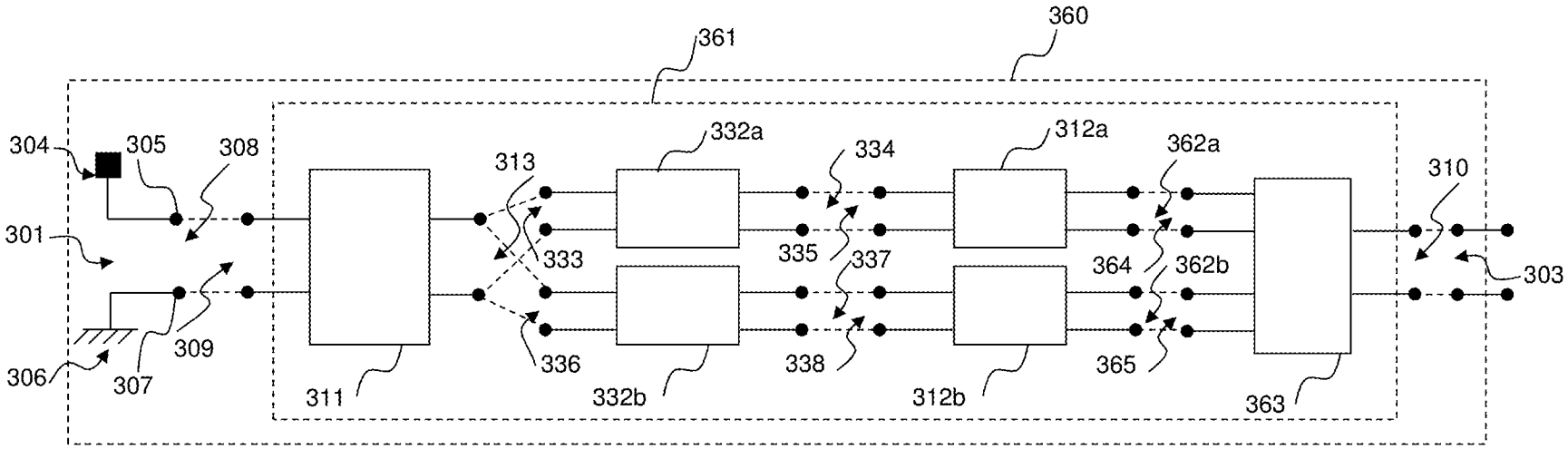

Regarding FIG. 3*c*, the radiating system 360 follows the same configuration as FIG. 3*b*, but it only has one external port 303. This is possible because the radiofrequency system 361 also comprises a combiner 363, which comprises three ports: the first port 364 is connected to the second port 362*a* of a first matching network 312*a*, the second port 365 is connected to the second port 362*b* of a second matching network 312*b*, and a third port 310 is connected to the external port 303 of the radiating system 360.

Figure 3D:
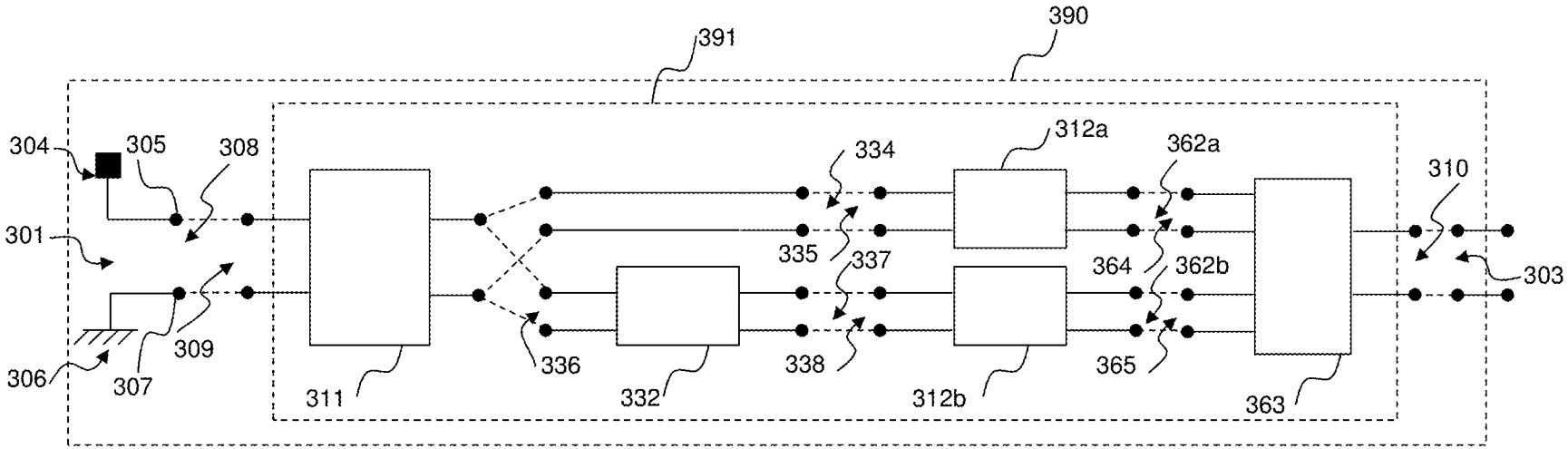

FIG. 3*d* shows a radiating system 390 comprising a radiating structure 301, a radiofrequency system 391, and one external port 303. This particular example shows a radiofrequency system comprising an impedance equalizer circuit 311, one filtering circuit 332, two matching networks 312*a* and 312*b*, and a combiner 363.

In other examples, the radiofrequency system 391 does not comprise a combiner 363 and therefore, the radiating system 390 has two external ports 303*a* and 303*b* (following a similar configuration like the one shown in FIG. 3*b*).

Such radiating systems depicted in FIGS. 3*a*-3*d* may be preferred when said radiating structure 301 is to provide operation in at least two cellular communication standards located in at least two frequency regions, such as LTE700, GSM 850, CDMA 850, GSM 900, GSM 1800, GSM 1900, CDMA 1900, UMTS/WCDMA 2100, LTE 2100, LTE 2300, LTE 2500, or in at least one cellular communication standard and at least one wireless connectivity standard, such as IEEE 802.11 standard, Bluetooth, Zigbee, UWB, WiMax, or alike.

Figure 4A:
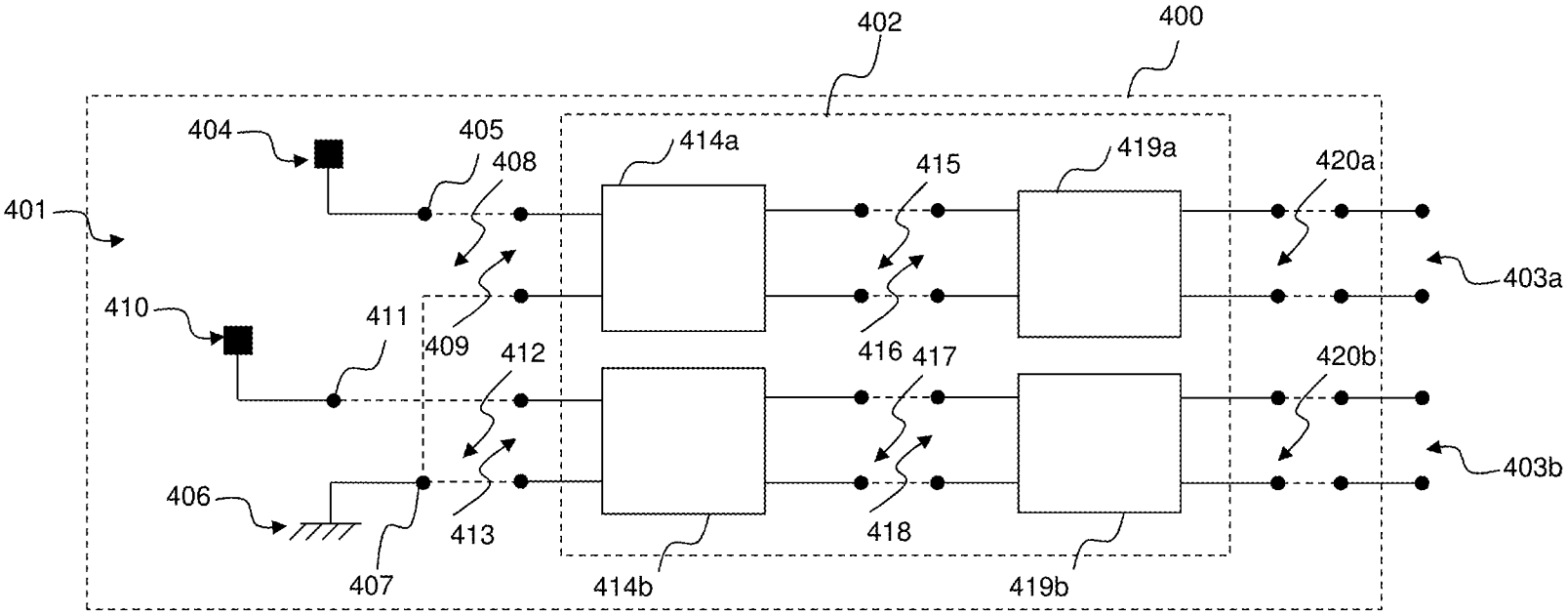
FIGS. 4*a*-4*c*—Schematic representations of 3 respective examples of radiating systems using two radiation boosters according to the present invention.
Figure 4B:
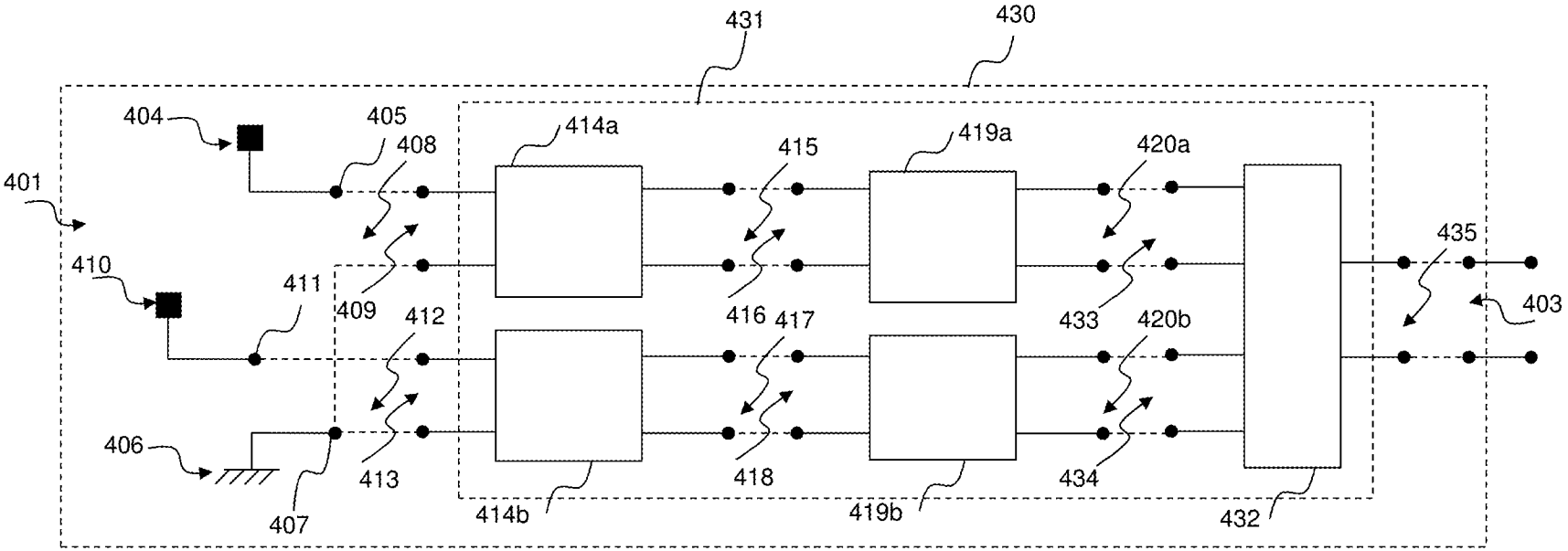
Figure 4C:
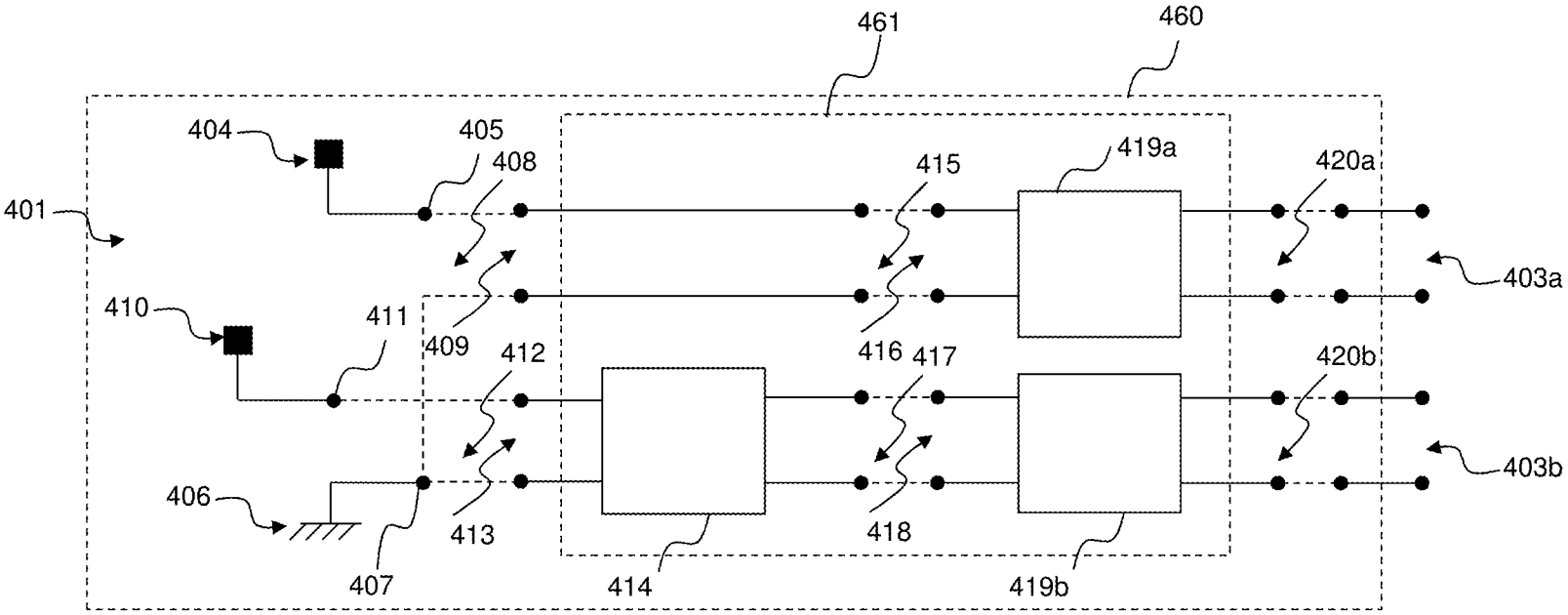

FIGS. 4*a*-4*c* show schematic representations of three examples of radiating systems for a concentrated wireless device capable of multiband operation according to the present invention.

FIG. 4*a* shows a radiating system 400 comprising a radiating structure 401, a radiofrequency system 402, and two external ports 403*a* and 403*b*. The radiating structure 401 comprises: a first radiation booster 404, which includes a connection point 405, a second radiation booster 410, which includes a connection point 411, and a ground plane layer 406, said ground plane layer also including a connection point 407. The radiating structure 401 further comprises a first internal port 408 defined between the connection point 405 of the first radiation booster 404 and the connection point 407 of the ground plane layer, and a second internal port 412 defined between the connection point 411 of the second radiation booster 410 and the connection point 407 of the ground plane layer. The radiofrequency system 402 comprises two filtering circuits 414*a* and 414*b*, and two matching networks 419*a* and 419*b*.

The first filtering circuit 414*a* comprises two ports: a first port 409 connected to the internal port 408 of the radiating structure 401, and a second port 415 connected to the first port 416 of a first matching network 419*a*. The second filtering circuit 414*b* also comprises two ports: a first port 413 connected to the internal port 412 of the radiating structure 401, and a second port 417 connected to the first port 418 of a second matching network 419*b*. The second ports 420*a* and 420*b* of the first and second matching networks 419*a* and 419*b* are connected to the first and second external ports 403*a* and 403*b*.

Regarding FIG. 4*b*, the radiating system 430 follows the same configuration as FIG. 4*a*, but it only has one external port 403. This is possible because the radiofrequency system 431 also comprises a combiner 432, which comprises three ports: the first port 433 is connected to the second port 420*a* of a first matching network 419*a*, the second port 434 is connected to the second port 420*b* of a second matching network 419*b*, and a third port 435 is connected to the external port 403 of the radiating system 430.

FIG. 4*c* shows a radiating system 460 comprising a radiating structure 401, a radiofrequency system 461, and two external ports 403*a* and 403*b*. The radiofrequency system 461 comprises one filtering circuit 414, and two matching networks 419*a* and 419*b*.

In other examples, the radiofrequency system 461 also comprises a combiner 432 (following a similar configuration like the one shown in FIG. 4*b*) and therefore, the radiating system 460 only has one external port.

Such radiating systems depicted in FIGS. 4*a*-4*c* may be preferred when said radiating structure 401 is to provide operation in at least two cellular communication standards located in at least two frequency regions, such as LTE 700, GSM 850, GSM 900, GSM 1800, GSM 1900, UMTS/WCDMA 2100, LTE 2300, LTE 2500, or in at least one cellular communication standard and at least one wireless connectivity standard, such as IEEE 802.11 standard, WiMax, Bluetooth, Zigbee, UWB or alike.

Figure 5:
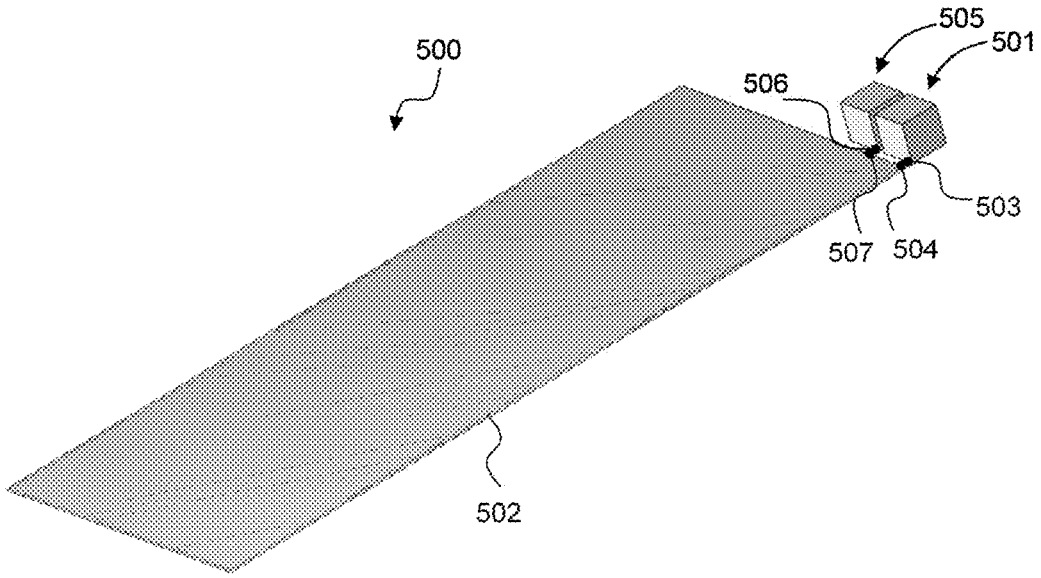
FIG. 5—Example of a radiating structure for a concentrated wireless device including a first and a second radiation booster aligned with the same axis.

In FIG. 5, the radiating structure 500 comprises a first radiation booster 501, a second radiation booster 505, and a ground plane layer 502. Both radiation boosters 501, 505 are arranged with respect to the ground plane layer so that the upper and bottom faces of both radiation boosters 501, 505 are substantially parallel to the ground plane layer 502. Moreover, both radiation boosters 501, 505 protrude beyond the ground plane layer 502. That is, the radiation boosters 501, 505 are arranged with respect to the ground plane layer 502 in such a manner that there is no ground plane in the orthogonal projection of the radiation boosters 501, 505 onto the ground plane containing the ground plane layer 502. The first radiation booster 501 is located substantially close to a first corner of the ground plane layer 502, while the second radiation booster 505 is located substantially close to the first radiation booster, in the same axis of the shortest side of the ground plane layer 502. Both radiation boosters 501, 505 are substantially parallel to the shortest side of the ground plane layer 502.

The first radiation booster 501 comprises a connection point 503 located on the lower right corner of the bottom face of the first radiation booster 501. In turn, the ground plane layer 502 also comprises a first connection point 504 substantially on the upper right corner of the ground plane layer 502. A first internal port of the radiating structure 500 is defined between said connection point 503 and said first connection point 504.

Similarly, the second radiation booster 505 comprises a connection point 506 located on the lower right corner of the bottom face of the second radiation booster 505. In turn, the ground plane layer 502 also comprises a second connection point 507 substantially on the upper right corner of the ground plane layer 502. A second internal port of the radiating structure 500 is defined between said connection point 506 and said second connection point 507. The distance between the first internal port and the second internal port is less than 0.06 times the wavelength at the lowest frequency of the first frequency region of operation. In a particular example, the distance between the internal ports of the radiating structure 500 shown in FIG. 5 is 2 mm, and each one of said first and second radiation boosters 501, 505 feature a volume of 5 mm×5 mm×5 mm on a ground plane layer having a rectangular shape of 120 mm×50 mm, which is representative of a smartphone.

The very small dimensions of the first and second radiation boosters 501, 505 result in said radiating structure 500 having at each of the first and second internal ports a first resonance frequency at a frequency much higher than the frequencies of the first frequency region. Furthermore, the first resonance frequency at each of the first and second internal ports of the radiating structure 500 is also at a frequency much higher than the frequencies of the second frequency region.

The radiofrequency system of FIG. 4*a* is suitable for interconnection with the radiating structure of FIG. 5.

As in previous example, the radiofrequency system of FIG. 4*b* and FIG. 4*c* may also be suitable for interconnection with the radiating structure of FIG. 5.

FIGS. 6*a*-6*c* and FIGS. 7*a*-7*d* show the input impedance transformation of the radiating structure shown in FIG. 5 caused by the different stages of the radiofrequency system 461.

Figure 6A:
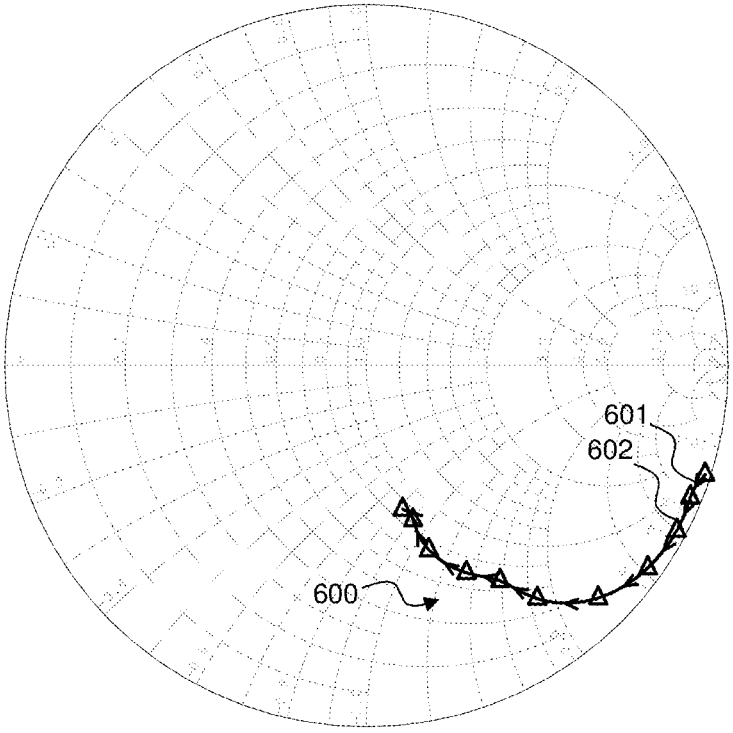
FIG. 6*a*—Impedance transformation caused by the radiofrequency system of FIG. 4*c* on the input impedance at the first internal port of the radiating structure of FIG. 5 when disconnected from the radiofrequency system.

In FIG. 6*a*, the input impedance at the first internal port of the radiating structure 500 without any radiofrequency system is represented by the curve 600 on Smith Chart as a function of frequency. As it can be observed, it presents a capacitive behavior (the imaginary part of the input impedance has a negative value) among the first and second frequency region. In particular, the point 601 corresponds to the input impedance at the lowest frequency of the first frequency region, and the point 602 to the highest frequency of the first frequency region.

Figure 6B:
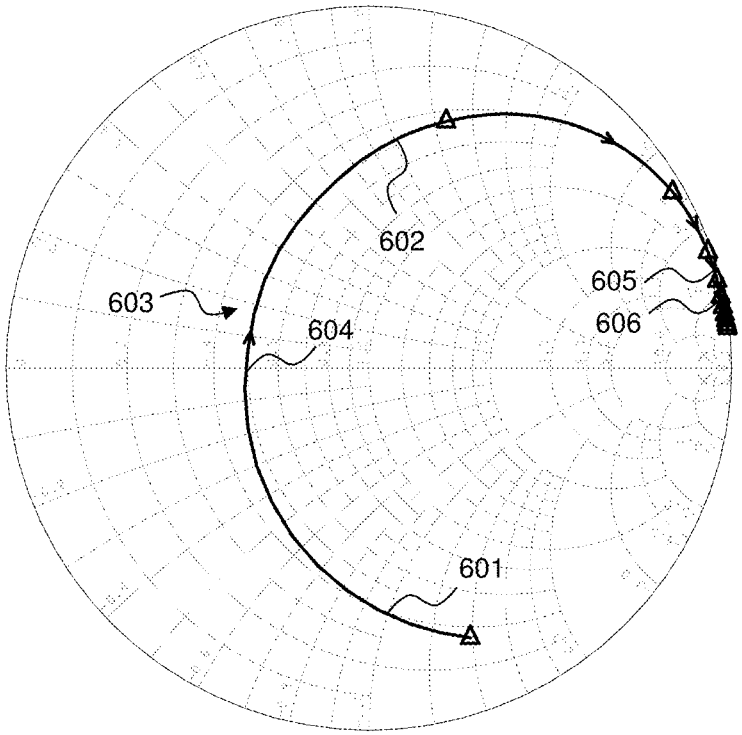
FIG. 6*b*—Impedance transformation caused by the radiofrequency system of FIG. 4*c* on the input impedance at the first internal port of the radiating structure of FIG. 5 after connection of a reactance cancellation circuit to the first internal port.
Figure 6C:
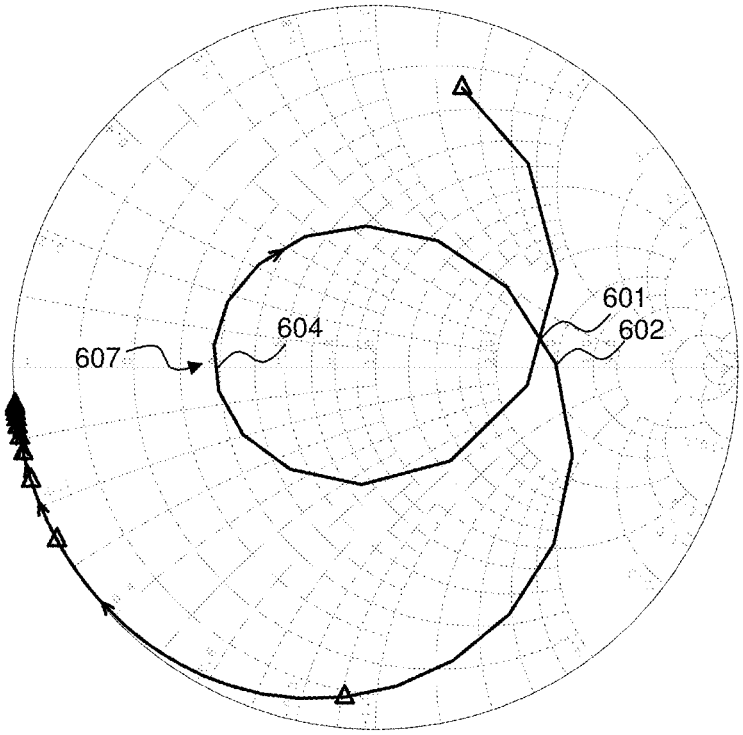
FIG. 6*c*—Impedance transformation caused by the radiofrequency system of FIG. 4*c* on the input impedance at the first internal port of the radiating structure of FIG. 5 after connection of a broadband matching circuit in cascade with the reactance cancellation circuit.

The input impedance after the first matching network 419*a* can be observed in FIG. 6*b* and FIG. 6*c*. With respect to FIG. 6*a*, the input impedance represented by the curve 603 in the Smith Chart of FIG. 6*b* has been transformed into an impedance having an imaginary part substantially close to zero for a frequency 604 advantageously between the lowest 601 and highest 602 frequencies of the first frequency region. As it can be also observed, the lowest 605 and highest 606 frequencies of the second frequency region present higher impedance values comparing to the frequencies among the first frequency region.

The input impedance at the external port 403*a* of the radiating system 460 of FIG. 4*c* can be observed in FIG. 6*c* by the curve 607 represented in the Smith Chart. Comparing FIGS. 6*b* and 6*c*, it is noticed that a broadband matching circuit has been used since the curve 603 has been modified into another curve 607 featuring an impedance loop around the center of the Smith chart. Thus, the resulting curve 607 exhibits an input impedance within a VSWR 3:1 referred to a reference impedance of 50 Ohms over a broader range of frequencies, in particular from the lowest frequency 601 to the highest frequency 602 of the first frequency region.

Figure 7A:
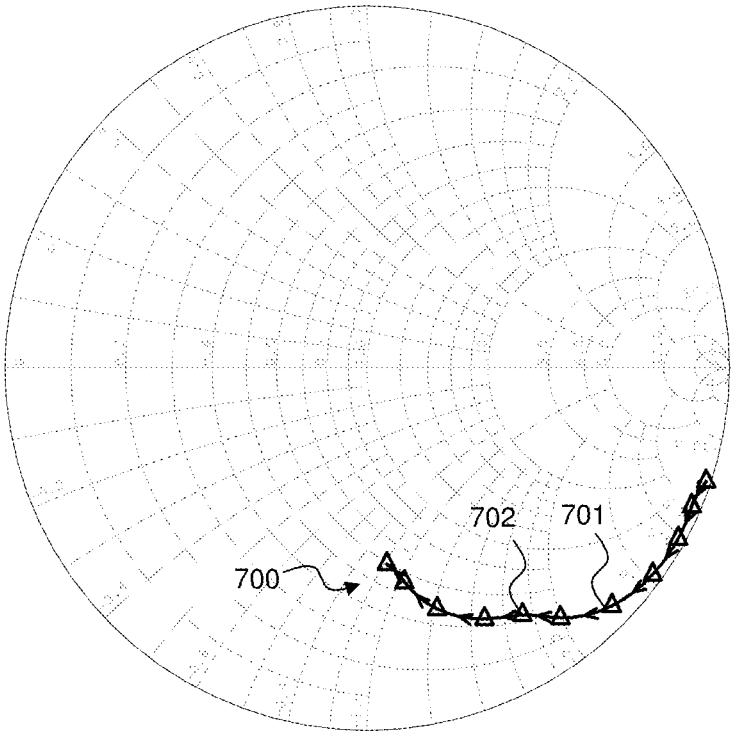
FIG. 7*a*—Impedance transformation caused by the radiofrequency system of FIG. 4*c* on the input impedance at the second internal port of the radiating structure of FIG. 5 when disconnected from the radiofrequency system.

Analogously, in FIG. 7*a*, the input impedance at the second internal port of the radiating structure 500 without any radiofrequency system is represented by the curve 700 on Smith Chart as a function of the frequency. As it can be observed, it presents a capacitive behavior among the first and second frequency region. In particular, the point 701 corresponds to the input impedance at the lowest frequency of the second frequency region, and the point 702 to the highest frequency of the second frequency region.

Figure 7B:
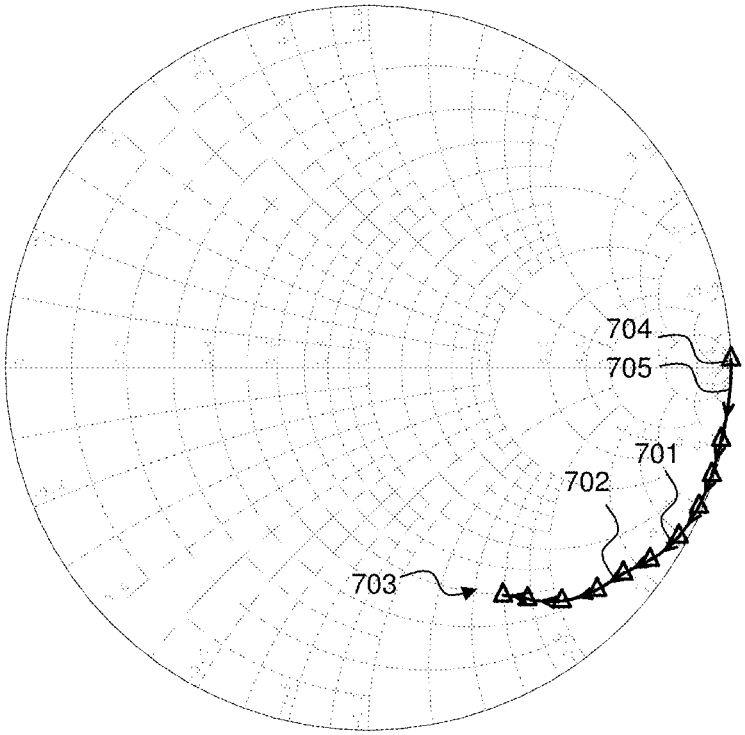
FIG. 7*b*—Impedance transformation caused by the radiofrequency system of FIG. 4*c* on the input impedance at the second internal port of the radiating structure of FIG. 5 after connection of a filtering circuit to the second internal port.

The effect of the filtering circuit 414 over the input impedance at the second internal port 412 can be observed in FIG. 7*b* by the curve 703. Said filtering circuit 414 is substantially transparent over the frequencies of the second frequency region 701, 702 but it transforms the input impedance among the frequencies of the first frequency region 704, 705. The modulus of the input impedance at the first frequency region is much higher after the effect of the filtering circuit.

Figure 7C:
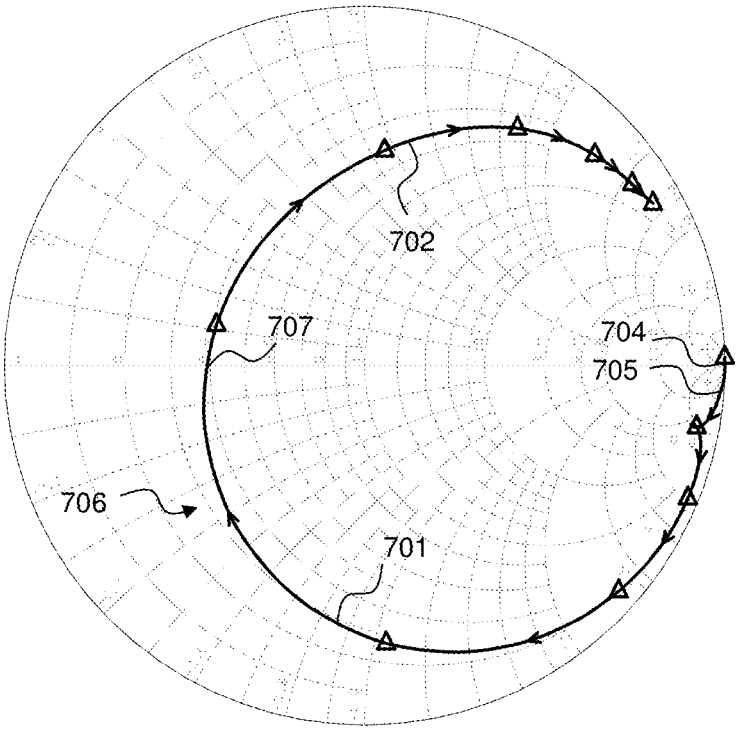
FIG. 7*c*—Impedance transformation caused by the radiofrequency system of FIG. 4*c* on the input impedance at the second internal port of the radiating structure of FIG. 5 after connection of a reactance cancellation circuit in cascade with the filtering circuit.

FIG. 7*c* shows the input impedance after the filtering circuit 414 and a first stage of the matching network 419*b*.

With respect to FIG. 7*a*, the input impedance represented by 706 in FIG. 7*c* has been transformed into an impedance having an imaginary part substantially close to zero for a frequency 707 advantageously between the lowest 701 and highest 702 frequencies of the second frequency region. As it can be also observed, the lowest 704 and highest 705 frequencies of the first frequency region still present higher impedance values comparing to the frequencies among the second frequency region.

Figure 7D:
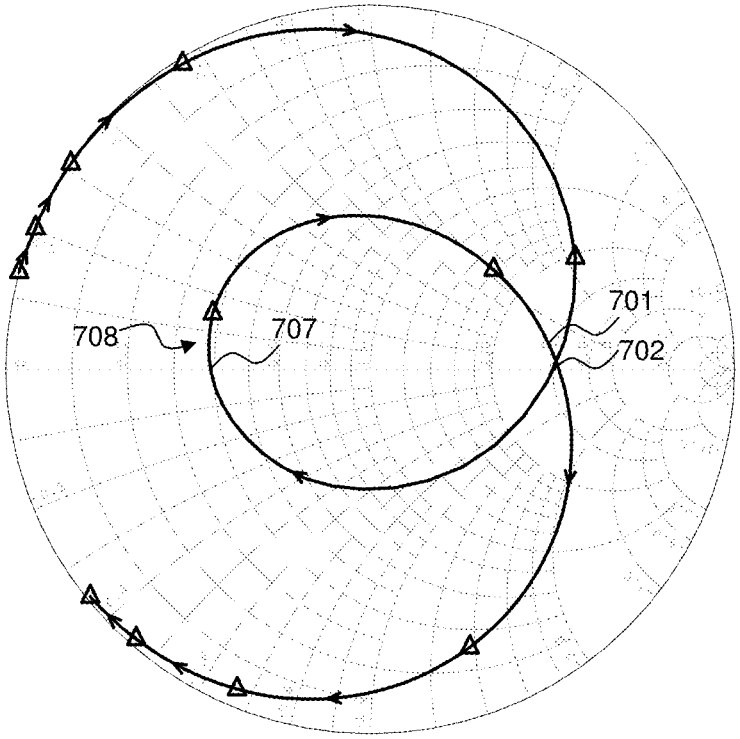
FIG. 7*d*—Impedance transformation caused by the radiofrequency system of FIG. 4*c* on the input impedance at the second internal port of the radiating structure of FIG. 5 after connection of a broadband matching circuit in cascade with the reactance cancellation circuit and the filtering circuit.

The input impedance at the external port 403*b* can be observed in FIG. 7*d* by the curve 708 represented in the Smith Chart. Comparing FIGS. 7*c* and 7*d*, it is noticed that a broadband matching circuit has been used since curve 706 have been modified transforming the curve 706 into another curve 708 featuring an impedance loop around the center of the Smith chart). Thus, the resulting curve 708 exhibits an input impedance within a VSWR 3:1 referred to a reference impedance of 50 Ohms over a broader range of frequencies, in particular from the lowest frequency 701 to the highest frequency 702 of the second frequency region.

Figure 8:
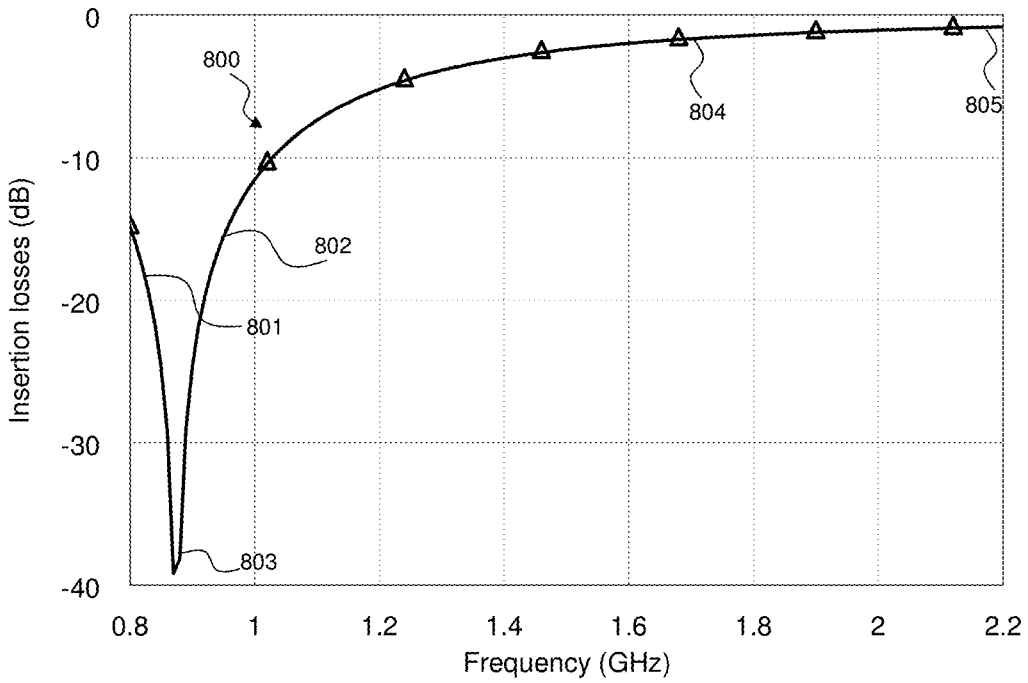
FIG. 8—Insertion losses of a resonant circuit used as a filtering circuit in the present invention.

FIG. 8 shows an example of a response of the filtering circuit 414 used in the radiofrequency system 461 of FIG. 4*c*. The insertion loss of a possible filtering circuit used in the present invention is represented by the curve 800 and it reflects the effect of a notch filter. The filtering circuit is required to provide high insertion loss from the lowest frequency 801 to the highest frequency 802 of the first frequency region, while presenting low insertion loss from the lowest frequency 804 to the highest frequency 805 of the second frequency region.

In the context of the present invention, low insertion losses are translated into insertion loss values of the filtering circuit larger than −5 dB, −3 dB, and preferably larger than −2 dB, while high insertion losses are translated into insertion losses values smaller than −8 dB, −10 dB, and preferably larger than −15 dB.

Figure 9A:
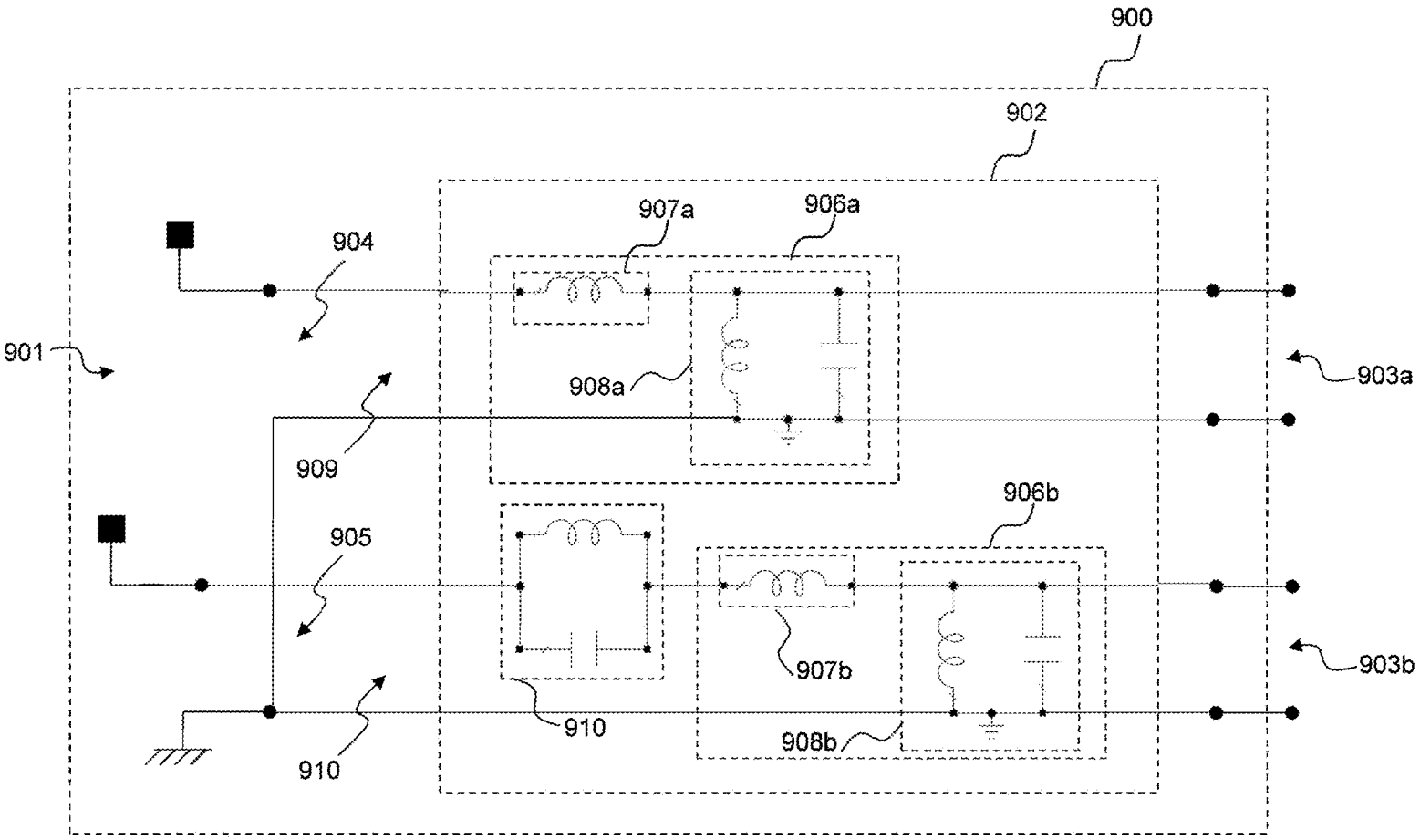
FIG. 9*a*—Radiating system resulting from the interconnection of a preferred example of the radiofrequency system of FIG. 4*c* and the radiating structure of FIG. 5.

In FIG. 9*a*, a preferred example of a possible configuration of the radiofrequency system 461 shown in FIG. 4*c* is presented by the radiofrequency 902. The radiating system 900 comprises a radiating structure 901, a radiofrequency system 902 and two external ports 903*a* and 903*b*. The radiating structure is the one shown in FIG. 5, which comprises a first internal port 904 and a second internal port 905. The radiofrequency system 902 comprises four ports: a first port 909 is connected to the first internal port 904 of the radiating structure 901, a second port 910 is connected to the second internal port 905 of the radiating structure 901, a third port is connected to the first external port 903*a* of the radiating system 900, and finally, a fourth port is connected to the second external port 903*b* of said radiating system 900.

The radiofrequency system 902 comprises the same stages/blocks as the ones in 461 shown in FIG. 4*c*. The first matching network 906*a* corresponds to 419*a*, the filtering circuit 910 corresponds to 414, and the second matching network 906*b* corresponds to 419*b*.

The first matching network 906*a* comprises a reactance cancellation 907*a* featuring a series inductor, and a broadband matching network 908*a* comprising two shunt lumped elements (one inductor and one capacitor).

The filtering circuit 910 comprises two shunt elements (one inductor and one capacitor) connected in series with the second matching network 906*b*.

The second matching network 906*b* comprises a reactance cancellation 907*b* featuring a series inductor, and a broadband matching network 908*b* comprising two shunt lumped elements (one inductor and one capacitor).

In yet other examples, the filtering circuit 910 is advantageously swapped with the reactance cancellation 907*b*, resulting in a new order of the elements that comprise the radiofrequency system 902. In fact, the order of said elements is not critical in order to obtain good radio-electric performance.

Figure 9B:
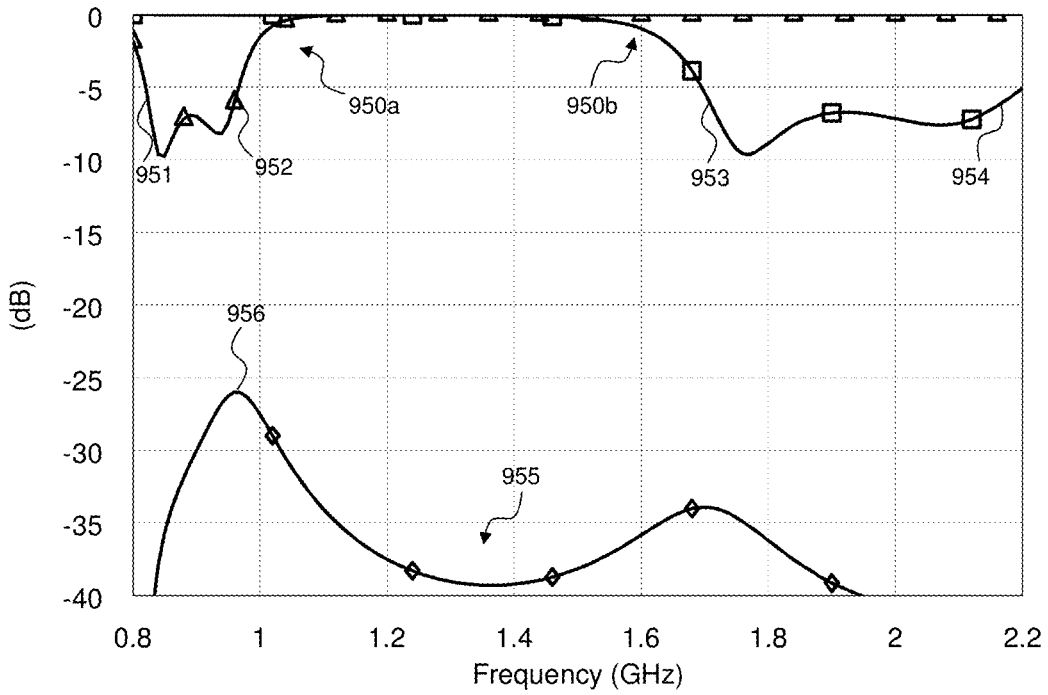
FIG. 9*b*—Reflection and transmission coefficients at the external ports of the radiating system of FIG. 9*a*.

The reflection coefficient observed at the external ports 903*a* and 903*b* is represented by the curves 950*a* and 950*b* in FIG. 9*b*, respectively. The coupling between both ports (903*a* and 903*b*) is represented by the curve 955. The curve 950*a* shows that the reflection coefficient at the first external port 903*a* is less than −6 dB (Voltage Standing Wave Ratio (VSWR) 3:1) from a first frequency 951 (corresponding to 824 MHz) to a second frequency 952 (corresponding to 960 MHz), while the curve 950*b* shows that the reflection coefficient at the external port 903*b* is less than −6 dB (VSWR 3:1) from a first frequency 953 (corresponding to 1710) to a second frequency 954 (corresponding to 2170 MHz). The coupling between both external ports 903*a* and 903*b* is less than −26 dB among the first and second frequency regions, which guarantees good radio-electric performance.

It is important to notice that the requirements of the VSWR and coupling may differ depending on the requirements of the cellular or wireless communication standards.

For example, the radiating system presented in FIG. 9*a* operates in GSM/WCDMA/CDMA 850/900/1800/1900, and UMTS/WCDMA/HSDPA 2100.

Figure 10A:
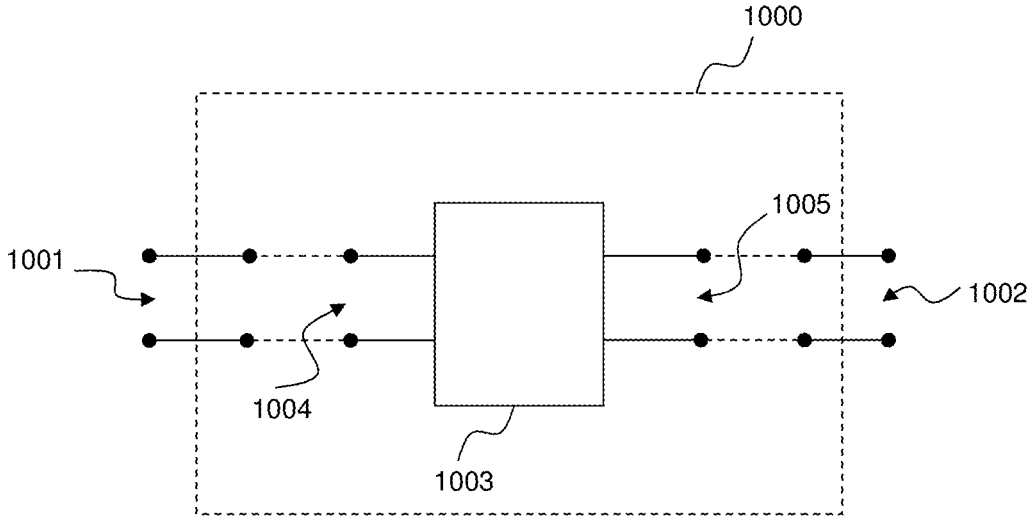
FIGS. 10*a*-10*c*—Block diagrams of 3 respective examples of matching networks for a radiofrequency system used in a radiating system according to the present invention.
Figure 10B:
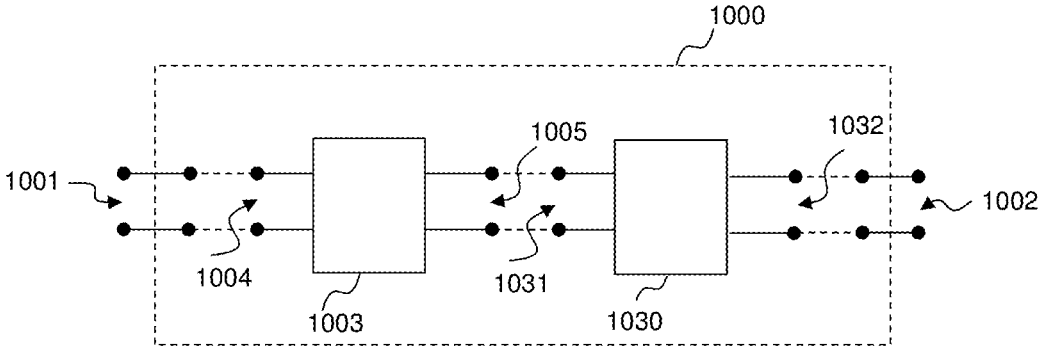
Figure 10C:
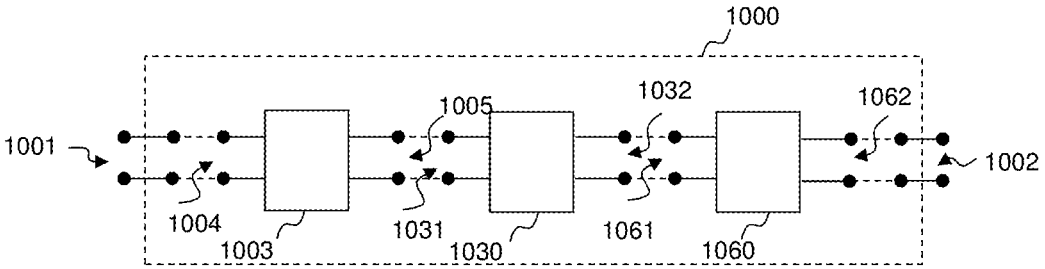

FIGS. 10*a*-10*c* show the block diagrams of three examples of a matching network 1000 for a radiofrequency system, the matching network 1000 comprising a first port 1001 and a second port 1002. One of said two ports may at the same time be a port of the radiofrequency system and, in particular, be interconnected with an internal port of a radiating structure.

In FIG. 10*a* the matching network 1000 comprises a reactance cancellation circuit 1003. In this example, a first port 1004 of the reactance cancellation circuit may be operationally connected to the first port 1001 of the matching network and another port 1005 of the reactance cancellation circuit may be operationally connected to the second port 1002 of the matching network.

Referring now to FIG. 10*b*, the matching network 1000 comprises the reactance cancellation circuit 1003 and a broadband matching circuit 1030, which is advantageously connected in cascade with the reactance cancellation circuit 1003. That is, a port of the broadband matching circuit 1031 is connected to port 1005. In this example, port 1004 is operationally connected to the first port of the matching network 1001, while another port of the broadband matching circuit 1032 is operationally connected to the second port of the matching network 1002.

FIG. 10*c* depicts a further example of the matching network 1000 comprising, in addition to the reactance cancellation circuit 1003 and the broadband matching circuit 1030, a fine tuning circuit 1060. Said three circuits are advantageously connected in cascade, with a port of the reactance cancellation circuit (in particular port 1004) being connected to the first port of the matching network 1001 and a port the fine tuning circuit 1062 being connected to the second port of the matching network 1002. In this example, the broadband matching circuit 1030 is operationally interconnected between the reactance cancellation circuit 1003 and the fine tuning circuit 1060 (i.e., port 1031 is connected to port 1005 and port 1032 is connected to port 1061 of the fine tuning circuit 1060).

Figure 11:
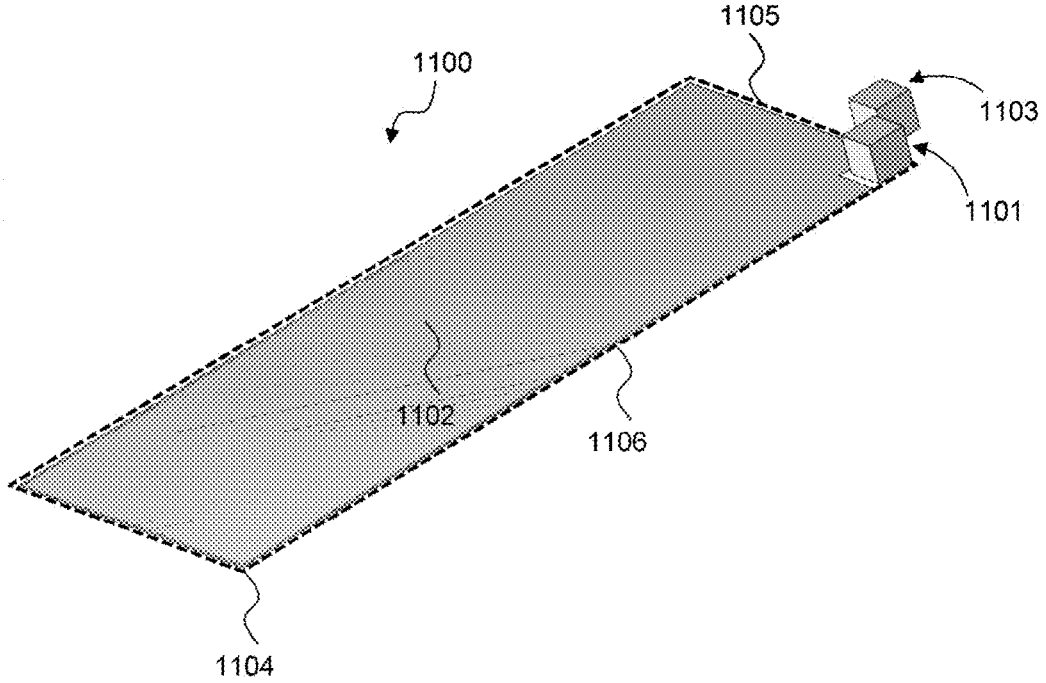
FIG. 11—Example of a radiating structure for a concentrated wireless device including a first and a second radiation booster in an orthogonal disposal.

In FIG. 11, the radiating structure 1100 comprises a first radiation booster 1101, a second radiation booster 1103, and a ground plane layer 1102, elements 1101 and 1102 being inscribed in a ground plane rectangle 1104. The ground plane rectangle has a short side 1105 and a long side 1106.

The first radiation booster 1101 is arranged substantially close to said long side 1106, and the second radiation booster 1103 is arranged substantially close to said short side 1105. Said first and second radiation boosters 1101, 1103 feature a concentrated configuration because they occupy a minimum area. In fact, the distance between the internal ports of the radiating structure 1100 defined by their connection points is less than 0.06 times the wavelength at the lowest frequency of the first frequency region, as it is required in the present invention.

In this particular case, the first radiation booster 1101 is arranged on a cut-out portion of the ground plane layer 1102, so that the orthogonal projection of the first radiation booster 1101 on said plane containing the ground plane layer 1102 does not overlap the ground plane layer. Moreover, said projection is completely inside the perimeter of the ground plane rectangle 1104. On the other hand, the second radiation booster 1103 protrudes beyond the short side 1105 of the ground plane rectangle 1104, so that the orthogonal projection of the second radiation booster 1103 on the plane containing the ground plane layer 1102 is outside the ground plane rectangle 1104.

However, in another example both the first and the second radiation boosters could have been arranged on cut-out portions of the ground plane layer, so that the radiation boosters are at least partially, or even completely, inside the perimeter of the ground plane rectangle associated to the ground plane layer of a radiating structure. And yet in another example, both the first and the second radiation boosters could have been arranged at least partially, or even completely, protruding beyond a side of said ground plane rectangle.

Figure 12:
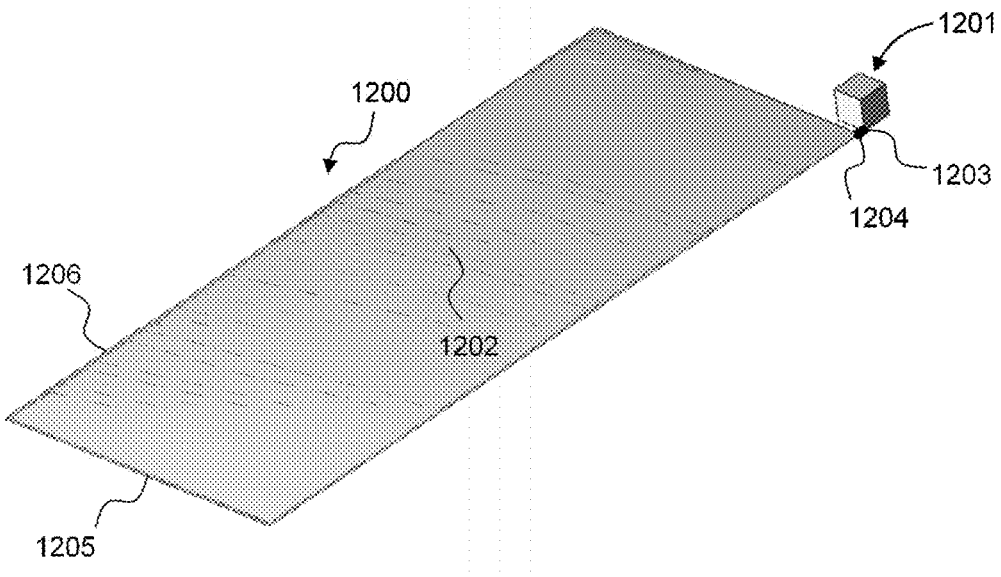
FIG. 12—Example of a radiating structure for a concentrated wireless device including one radiation booster.

FIG. 12 presents a radiating structure 1200 comprising a first radiation booster 1201 and a ground plane layer 1202. The radiating structure 1200 comprises one internal port: said internal port being defined between a connection point 1203 of the first radiation booster 1201 and a first connection point 1204 of the ground plane layer 1202.

The ground plane layer 1202 features a substantially rectangular shape having a short edge 1205 and a long edge 1206. In this example, the radiation booster 1201 is substantially close to a first corner of the ground plane layer.

The radiofrequency system 302 of FIG. 3*a* is suitable for interconnection with the radiating structure of FIG. 12. The radiofrequency system 302 comprises an impedance equalizer circuit 311. A port 309 of said impedance equalizer circuit 311 is connected to the internal port of the radiating structure 1200.

Similar, to the previous example, the radiofrequency system 331 of FIG. 3*b* is suitable for interconnection with the radiating structure of FIG. 12. The radiofrequency system 331 comprises an impedance equalizer circuit 311. A port 309 of said impedance equalizer circuit 311 is connected to the internal port of the radiating structure 1200.

As in previous example, the radiofrequency system 361 of FIG. 3*c* is suitable for interconnection with the radiating structure of FIG. 12. The radiofrequency system 361 comprises a first impedance equalizer circuit 311. A port of said impedance equalizer circuit 311 is connected to the internal port of the radiating structure 1200.

As in previous example, the radiofrequency system 391 of FIG. 3*d* is also suitable for interconnection with the radiating structure of FIG. 12.

Figure 13A:
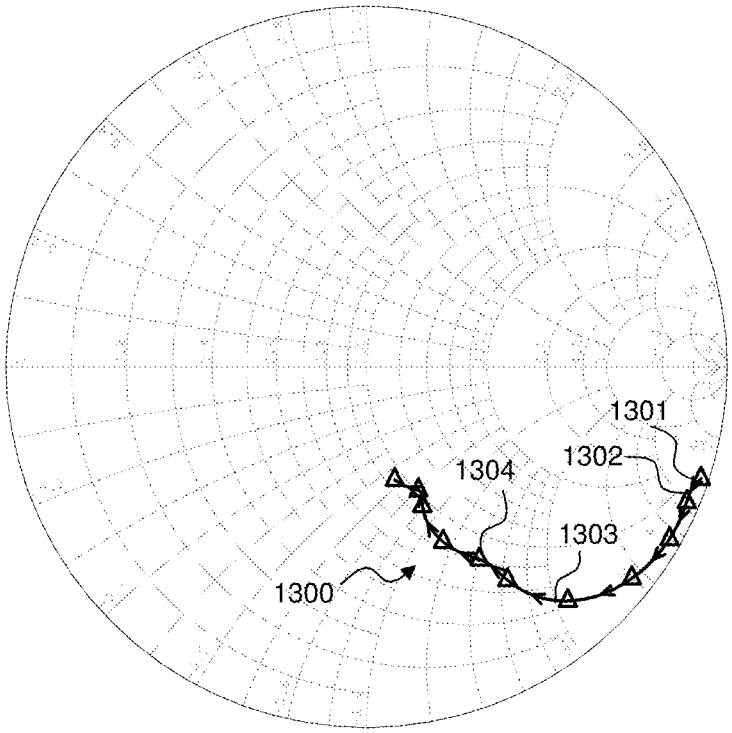
FIG. 13*a*—Input impedance at the first internal port of the radiating structure shown in FIG. 12 when disconnected from the radiofrequency system.

FIG. 13*a* shows the input impedance represented by the curve 1300 in the Smith Chart at the internal port of the radiating structure 1200. 1301 and 1302 represent the lowest and highest frequencies of the first frequency region, respectively. 1303 and 1304 represent the lowest and highest frequencies of the second frequency region, respectively.

Figure 13B:
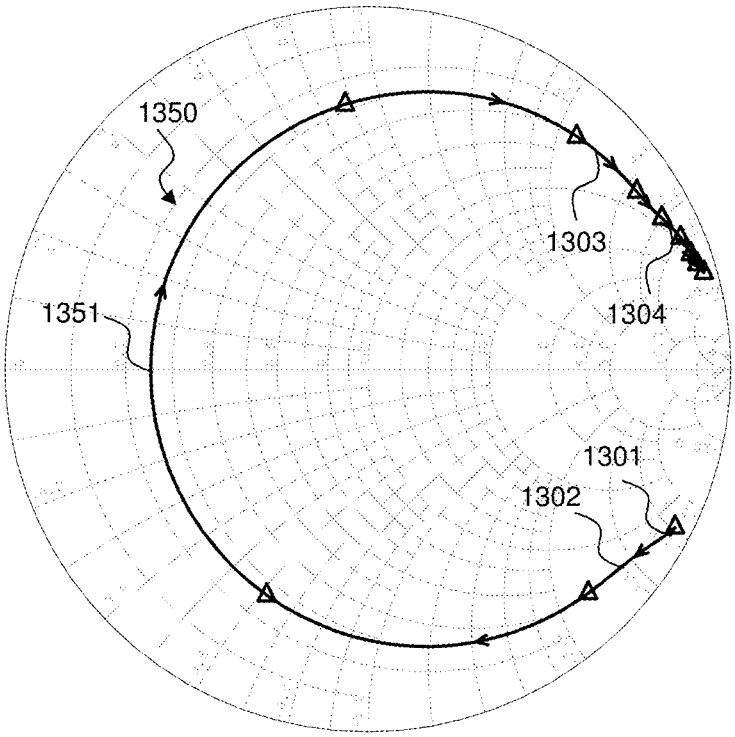
FIG. 13*b*—Impedance transformation caused by the impedance equalizer of the radiofrequency system of FIG. 3*d* on the input impedance at the first internal port of the radiating structure of FIG. 12.

The effect of the impedance equalizer circuit 311 can be observed in FIG. 13*b* by the curve 1350, in which the input impedance at the internal port of the radiating structure 1200 (curve 1300 in FIG. 13*a*) is transformed by said impedance equalizer circuit 311 into an impedance having an imaginary part substantially equal to zero at a frequency 1351 larger than the highest frequency 1302 of the first frequency region and lower than the lowest frequency 1303 of the second frequency region. Said frequency 1351 is advantageously adjusted to be the approximately the average between the highest frequency of the first frequency region and the lower frequency of the second frequency region. A further effect of the impedance equalizer circuit is observed in the input impedance curve 1350 within the first frequency region (delimited by the lowest frequency 1301 and the highest frequency 1302) and in the input impedance curve 1350 within the second frequency region (delimited by the lowest frequency 1303 and the highest frequency 1304), wherein both impedance curves are substantially complex conjugated. Having both impedance curves a substantially complex conjugated behavior simplifies the number of components of the following stages of the radiofrequency system.

Figure 14A:
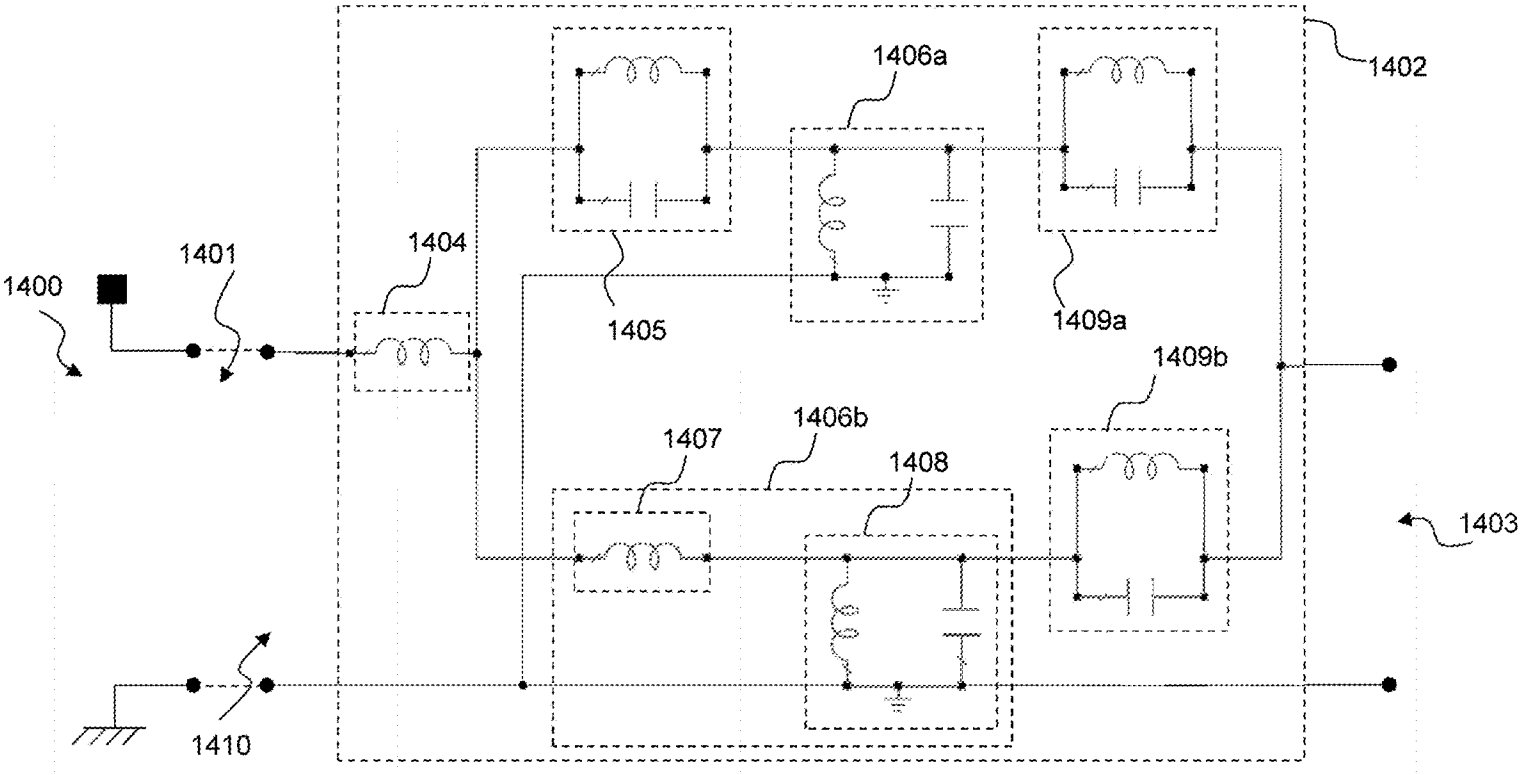
FIG. 14*a*—Radiating system resulting from the interconnection of a preferred example of the radiofrequency system of FIG. 3*d* and the radiating structure of FIG. 12.

FIG. 14*a* shows a radiating structure 1400 that comprises one internal port 1401 and one radiofrequency system 1402. The first port 1410 of the radiofrequency system 1402 is connected to the internal port 1401 of the radiating structure 1400. Said radiofrequency system 1402 is suitable for interconnection with the radiating structure 1200 of FIG. 12. In particular, said radiofrequency system 1402 corresponds to a particular example of the radiofrequency system scheme shown in FIG. 3*d*. For example, the impedance equalizer circuit 311 corresponds to the inductor 1404. The filtering circuit 332 corresponds to the filter 1405. The matching network 312*a* corresponds to the circuit 1406*b*, which comprises a reactance cancellation circuit 1407 and a broadband matching network 1408. The matching network 312*b* corresponds to the circuit 1406*a*, which is a broadband matching network. Finally, the combiner 363 comprises a first resonant circuit 1409*a* and a second resonant circuit 1409*b*.

Figure 14B:
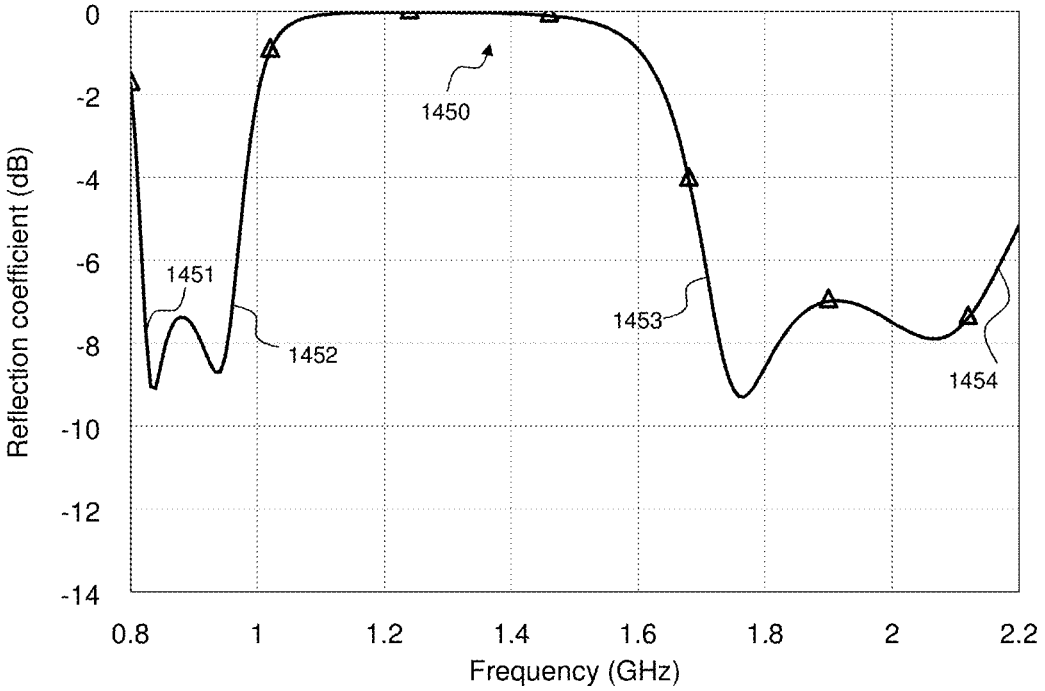
FIG. 14*b*—Reflection coefficient at the external port of the radiating system of FIG. 14*a*.

The impedance response of the radiating system resulting from the interconnection of the radiofrequency system 1402 of FIG. 14*a* to the radiating structure 1200 of FIG. 12 is shown in FIG. 14*b*. FIG. 14*b* shows the reflection coefficient 1450 at the external port 1403 of the radiating system. The first frequency region of operation (VSWR 3:1) ranges from the lowest frequency 1451 to the highest frequency 1452, which corresponds to 824 MHz and 960 MHz. This frequency region provides operability at GSM 850 and GSM 900 for example. Similarly, the second frequency region of operation (VSWR 3:1) ranges from the lowest frequency 1453 to the highest frequency 1454, which corresponds to 1710 MHz and 2170 MHz. This frequency region provides operability at GSM 1800, GSM 1900, WCDMA 1700, and UMTS/WCDMA 2100, for example.

Figure 15A:
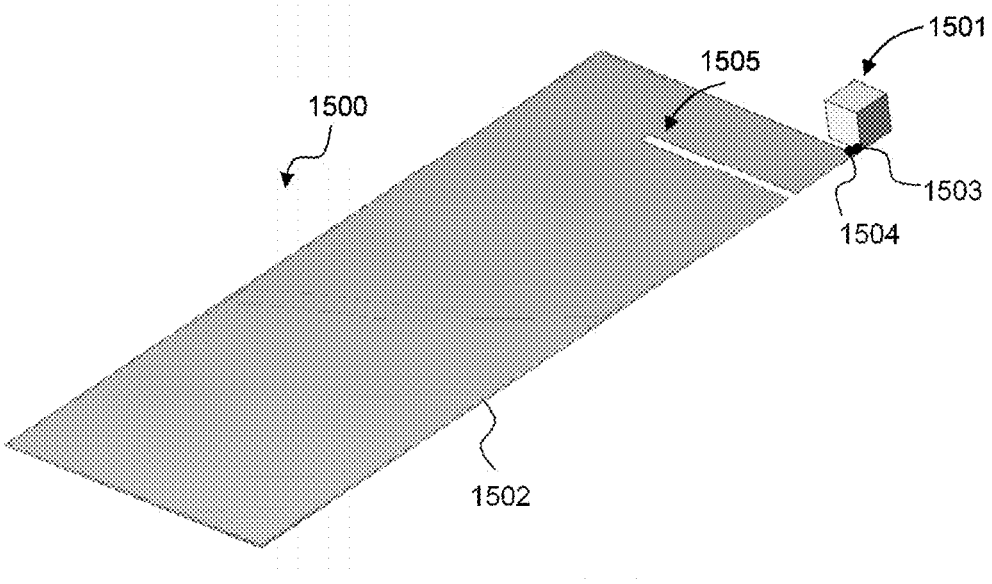
FIG. 15*a*—Example of a radiating structure for a concentrated wireless device including a first radiation booster and a slot in the ground plane layer.

FIG. 15*a* shows an example of a radiating structure 1500 comprising a radiation booster 1501, a ground plane layer 1502, and a slot 1505 in the ground plane layer 1502. The radiating structure 1500 comprises one internal port: said internal port being defined between a connection point 1503 of the first radiation booster 1501 and a first connection point 1504 of the ground plane layer 1502.

The radiation booster 1501 includes a conductive part featuring a polyhedral shape comprising six faces. The slot 1505 in the ground plane enhances the impedance bandwidth of the radiating system in at least one frequency region of operation. The size of the slot 1505 and its position in the ground plane layer 1502 are optimized in order to excite radiation modes in the ground plane to enhance the impedance bandwidth in at least one frequency region of operation.

In yet other examples, the slot 1505 in the ground plane layer 1502 enables a simplification of the number of components in a radiofrequency system with respect a solution without the slot. In this sense, if the number of components of the radiofrequency system is reduced, the radiating system has greater efficiency and it is more robust to the tolerances of the components.

In a further example, the slot 1505 in the ground plane layer 1502 enables a reduction of the size of the radiation booster in comparison with an example without a slot in the ground plane layer.

In other examples, the radiation booster 1501 is shaped as other radiation boosters such as for example the radiation boosters 1701, or 1703, or 1733, 2161, or 2181 (FIGS. 17*a*-17*c* and 21*a*-21*c*).

The radiofrequency system 302, or 331, 361, or 391 are suitable for interconnection with the radiating structure 1500 of FIG. 15*a*.

Figure 15B:
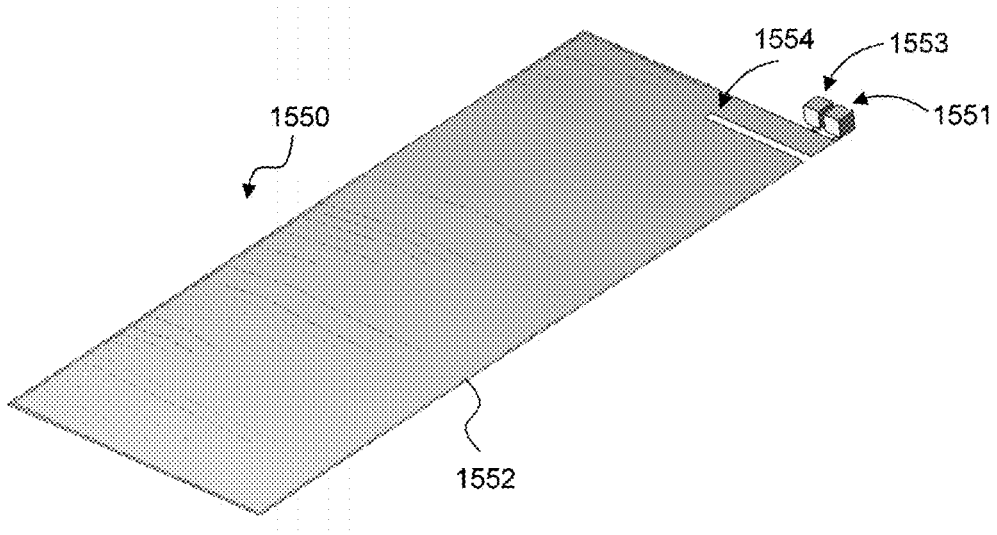
FIG. 15*b*—Example of a radiating structure for a concentrated wireless device including a first radiation booster, a second radiation booster and a slot in the ground plane layer.

FIG. 15*b* illustrates an example of a radiating structure 1550 comprising two radiation boosters 1551 and 1553, a ground plane layer 1552, and a slot 1554 in the ground plane layer 1552. According to the present invention, the location of the at least two radiation boosters follows a concentrated configuration.

The advantage of the slot 1554 in the ground plane layer 1552 is to better excite a radiation mode on the ground plane layer. A better excitation of the ground plane layer enhances the efficiency and/or impedance bandwidth of the radiating system. A further advantage of this example is shown when comparing the size of the radiation boosters 501 and 505 of FIG. 5 to the radiation boosters 1551 and 1553 of FIG. 15*b*, which are smaller.

The slot 1554 in the ground plane layer 1552 is optimized in length, size, and position in the ground plane layer in order to improve the radio-electric performance of the radiating system in at least one frequency region of operation.

In some other examples, other kind of radiation boosters such as 1701, or 1703, or 1733, or 2161, or 2181 (FIGS. 17*a*-17*c* and 21*a*-21*c*) are combined with one slot in the ground plane layer to improve the radio-electric performance of the radiating system in at least one frequency region of operation.

Figure 16A:
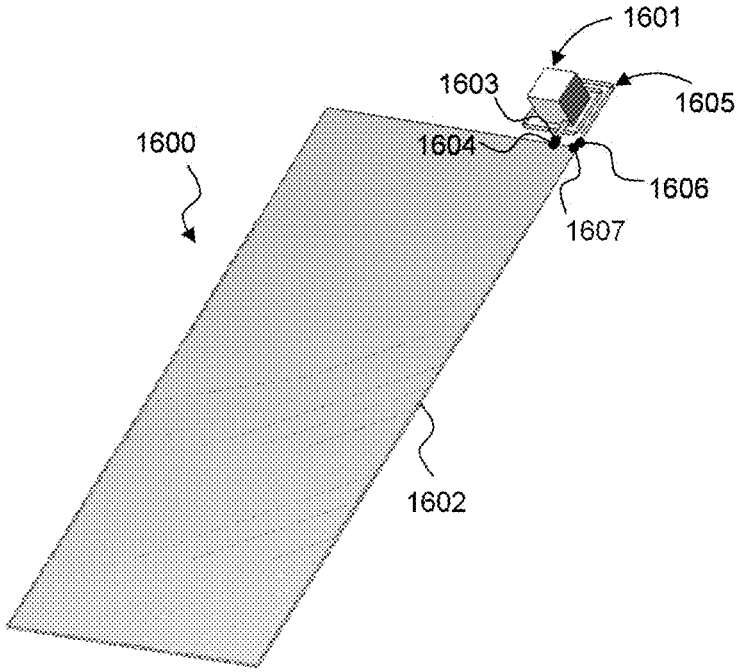
FIG. 16*a*—Example of a radiating structure for a concentrated wireless device including a first radiation booster and an antenna element.

FIG. 16*a* shows an example of a radiating structure 1600 comprising a radiation booster 1601, an antenna element 1605, and a ground plane layer 1602.

The radiation booster 1601 comprises a connection point 1603. In turn, the ground plane layer 1602 comprises a first connection point 1604 substantially on the upper right corner of the ground plane layer 1602. A first internal port of the radiating structure 1600 is defined between said connection point 1603 and said first connection point 1604.

Similarly, the antenna element 1605 comprises a connection point 1606 and the ground plane layer 1602 comprises a second connection point 1607, substantially on the upper right corner of the ground plane layer 1602. A second internal port of the radiating structure 1600 is defined between said connection point 1606 and said second connection point 1607. The radiation booster 1601 includes a conductive part featuring a polyhedral shape comprising six faces and the antenna element 1605 comprises a planar conductive structure. The projection of said antenna element 1605 does not overlap the ground plane layer 1602. Said antenna element 1605 operates in at least one frequency band of one frequency region.

The distance between said first and second internal ports of the radiating structure 1600 is less than 0.06 times the wavelength at the lowest frequency of operation of the first frequency region, resulting in a concentrated configuration according to the present invention.

Figure 16B:
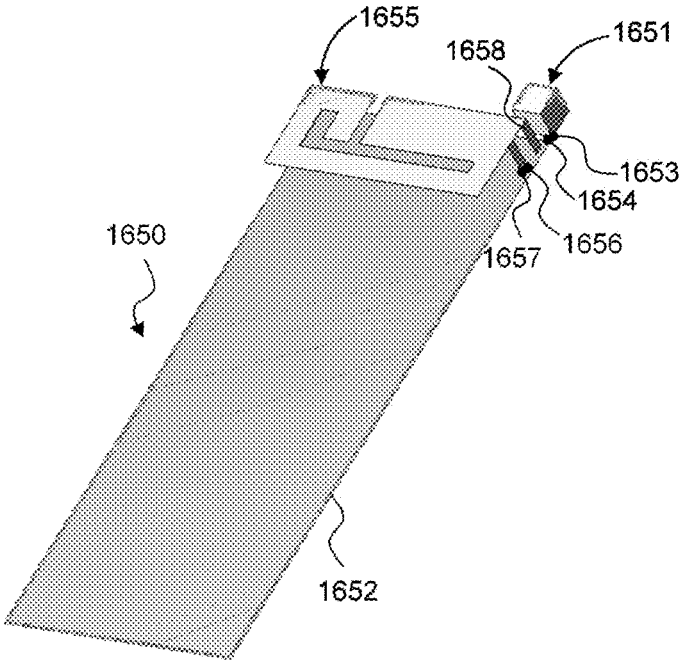
FIG. 16*b*—Example of another radiating structure for a concentrated wireless device including a first radiation booster and an antenna element.

FIG. 16*b* shows a further example of a radiating structure 1650 comprising a radiation booster 1651, an antenna element 1655, and a ground plane layer 1652. For this example, the orthogonal projection of the antenna element 1655 completely overlaps the ground plane layer 1652. In other examples, the orthogonal projection of the antenna element 1655 overlaps the ground plane layer 1652 by less than a 75%, less than a 50%, or even less than a 25% of the area of said antenna element 1655.

The radiation booster 1651 comprises a connection point 1653. In turn, the ground plane layer 1652 comprises a first connection point 1654 substantially on the upper right corner of the ground plane layer 1652. A first internal port of the radiating structure 1650 is defined between said connection point 1653 and said first connection point 1604.

Similarly, the antenna element 1655 comprises a connection point 1656 and the ground plane layer 1652 comprises a second connection point 1657, substantially on the upper right corner of the ground plane layer 1652. A second internal port of the radiating structure 1650 is defined between said connection point 1656 and said second connection point 1657. For this example, the antenna element has a grounding connection 1658 for impedance matching purposes of the antenna element.

The distance between said first and second internal ports of the radiating structure 1650 is less than 0.06 times the wavelength at the lowest frequency of operation of the first frequency region, resulting in a concentrated configuration according to the present invention.

The combination of at least one radiation booster and at least one antenna element according to the present invention like the ones shown in FIG. 16*a* and FIG. 16*b* increases the number of frequency bands in at least one frequency region of operation. In some examples, the antenna element operates in a first frequency region and the radiation booster in a second frequency region. In some other examples, the antenna element operates in two frequency regions and the radiation booster increases the number of bands in at least one frequency region of operation. In other example, the antenna element operates in two frequency regions and the radiation booster operates in a third frequency region.

Figure 17A:
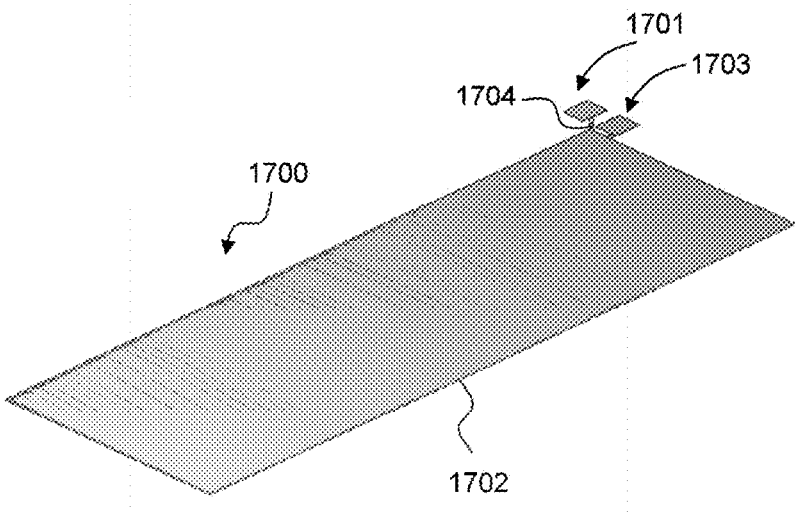
FIGS. 17*a*-17*c*—Examples of 3 respective radiating structures for a radiating system including several concentrated configurations of radiation boosters.
Figure 17B:
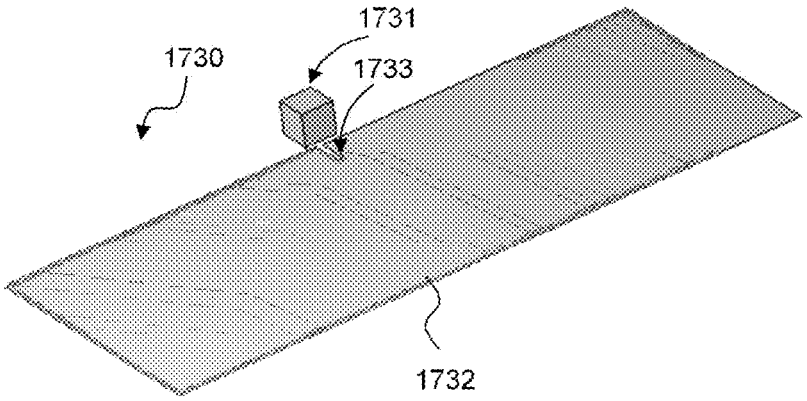
Figure 17C:
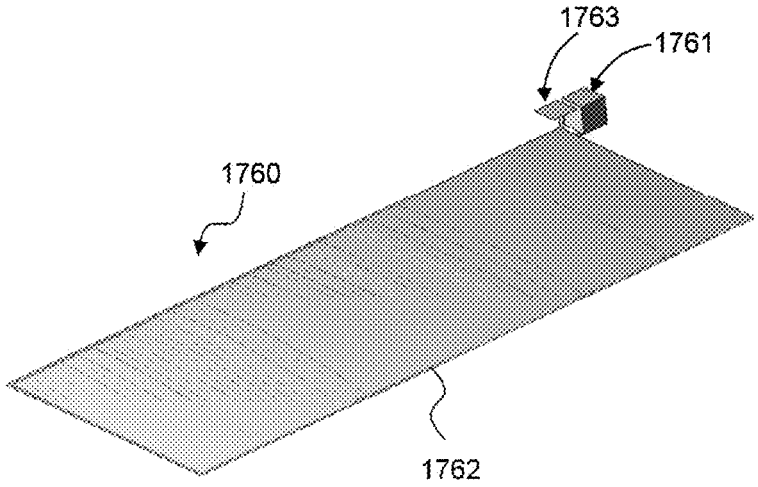

FIGS. 17*a*-17*c* show several examples of radiating structures 1700, 1730, and 1760 comprising different concentrated configurations of different kind of radiation boosters. The radiation booster 1701 presents a conductive planar portion substantially parallel to the ground plane layer 1702 and a vertical conductive portion 1704. The radiation booster 1703 shows a conductive portion having a planar profile substantially coplanar to the ground plane layer 1702. The orthogonal projection of the radiation booster 1703 does not overlap the ground plane layer 1702 whereas the orthogonal projection of the radiation booster 1701 overlaps the ground plane layer. The advantage of this concentrated configuration is to minimize the coupling between the radiation boosters. The reduction of the coupling simplifies the filtering circuits used in the radiofrequency system such as those used in the radiofrequency systems of FIG. 4*a*, FIG. 4*b*, or FIG. 4*c*, in particular the filtering circuits 414*a*, or 414*b*.

FIG. 17*b* shows another example of a radiating structure 1730 comprising a first radiation booster 1731, a second radiation booster 1733, and a ground plane layer 1732. The first radiation booster 1731 includes a conductive part featuring a polyhedral shape comprising six faces whereas the second radiation booster 1733 is a gap in the ground plane layer 1732. Similar to the previous example, the coupling between radiation boosters is minimized due to the capacitive impedance of the radiation booster 1731 and the inductive impedance of the radiation booster 1733. This coupling reduction between radiation boosters simplifies the filtering circuits of the radiofrequency system such as those illustrated in FIG. 4*a*, FIG. 4*b*, or FIG. 4*c*, in particular, the filtering circuits 414*a*, 414*b*, and 414.

In a similar manner, the radiating structure 1760 of FIG. 17*c* comprises a first radiation booster 1761 and a second radiation booster 1763, and a ground plane layer 1762. Said arrangement is advantageous for minimizing the coupling between the internal ports of the radiating structure 1760. Said reduction of the coupling simplifies the filtering circuits required to reduce the interaction between radiation boosters. Therefore, this simplification of the filtering circuit results in less number of components in the radiofrequency system and more radiation efficiency is obtained.

Figure 18:
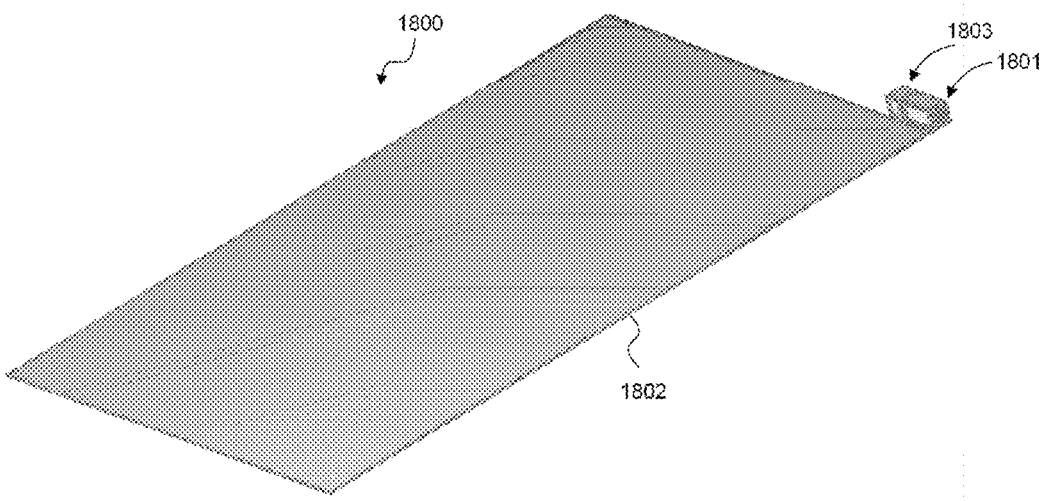
FIG. 18—Example of a radiating structure for a concentrated wireless device including a first and a second radiation booster included in a tablet device.

FIG. 18 shows a radiating structure 1800 comprising two radiation boosters 1801 and 1803 located on a rectangular ground plane layer 1802 having representative dimensions of a tablet device. Some representative dimensions of a tablet device are 197 mm×133 mm, 240 mm×180 mm, 194 mm×122 mm, 230 mm×158 mm, 257 mm×173 mm, 190 mm×120 mm, 179 mm×110 mm, or 271 mm×171 mm. The radiation boosters 1801 and 1803 include a conductive part featuring a polyhedral shape comprising six faces. Other cases use ground plane boosters such as for example 1701, or 1703, or 1733, or 2161, or 2181.

In particular, the radiation booster 1801 has a different dimension than the radiation booster 1803. Generally, having different dimensions of radiation boosters is advantageously used is some examples for having more degrees of freedom to adjust the impedance in at least one frequency region of operation. Although this combination of two or more boosters is shown here for a tablet-like device, it is used as well in other embodiments of wireless devices such as cellphones and smart phones according to the present invention.

Figure 19A:
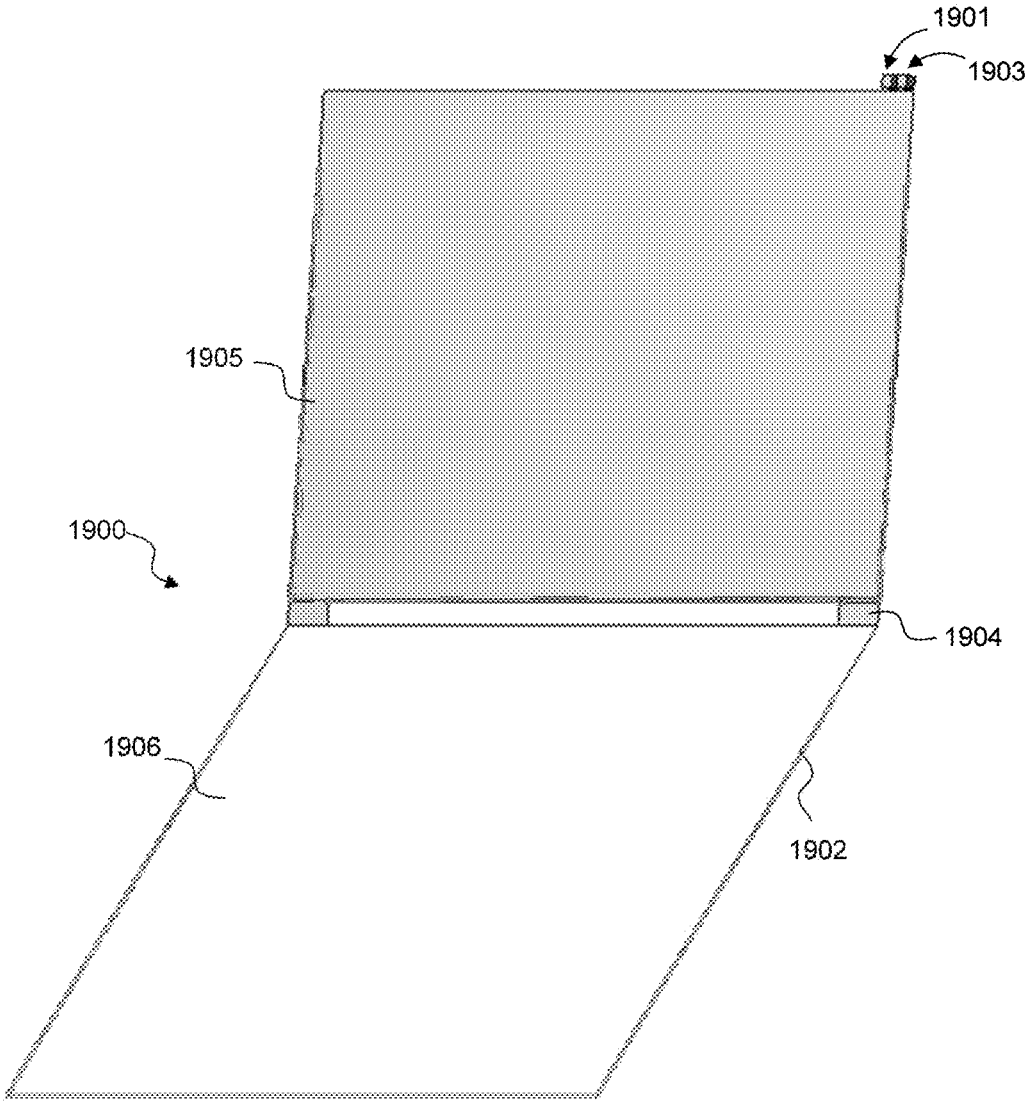
FIGS. 19*a* and 19*b*—Examples of 2 respective radiating structures for a concentrated wireless device including a first and a second radiation booster included in a laptop device.
Figure 19B:
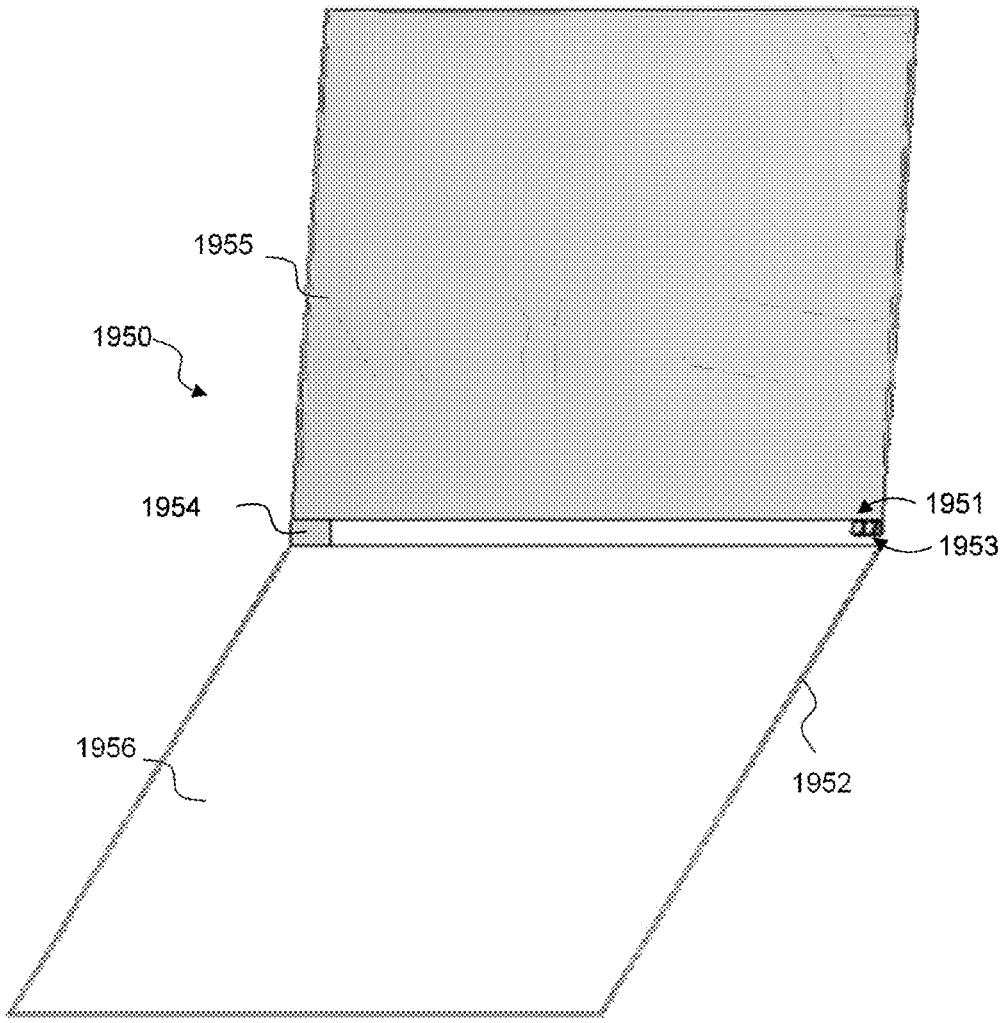

FIGS. 19*a* and 19*b* show two examples of radiating structures 1900 and 1950 comprising two radiation boosters in a two-body configuration representative of a laptop. FIG. 19*a* shows an example of a radiating structure comprising two radiation boosters 1901 and 1903 in a concentrated configuration, and a ground plane layer 1902 representative of a laptop. Said ground plane layer 1902 comprises two parts 1905 and 1906 which are connected through a connection means 1904. Said connection means 1904 is located in the hinge area. In some examples, the connection means is at the center of the hinge area while in other examples; there is more than one connection means.

The radiation boosters 1901 and 1903 include a conductive part featuring a polyhedral shape comprising six faces. In other examples, radiation boosters such as for example 1701, or 1703, or 1733, or 2161, or 2181 are used. The radiation boosters 1901 and 1903 are located in the upper part 1905 near a corner in a concentrated configuration according to the present invention. Said concentrated configuration is advantageous since it minimizes the area occupied by said radiation boosters. Therefore, more space is available to include other components such as the display.

FIG. 19*b* shows a radiating structure 1950 comprising two radiation boosters 1951 and 1953 in a concentrated configuration, and a ground plane layer 1952 representative of a laptop. As in FIG. 19*a*, the ground plane layer 1952 comprises two parts 1955 and 1956, which are connected through a connection means 1954. For this example, the location of the radiation boosters is in the upper part 1955 substantially close to a corner close to the hinge area. This location is advantageous for reducing the routing of the electromagnetic signal to the integrated circuit performing radiofrequency functionality (usually called Front End Module), which is usually located in 1956. This feature is advantageous at high frequencies such as those above 2 GHz where losses due to transmission lines carrying the radiofrequency signal suffer from losses. Therefore, if the distance between the radiation boosters and the integrated circuit performing radiofrequency functionality is minimized, the losses are also minimized. This guarantees a more efficient radiating system.

The radiation boosters 1951 and 1953 include a conductive part featuring a polyhedral shape comprising six faces. In other examples, radiation boosters such as for example 1701, or 1703, or 1733, or 2161, or 2181 are used.

Figure 20A:
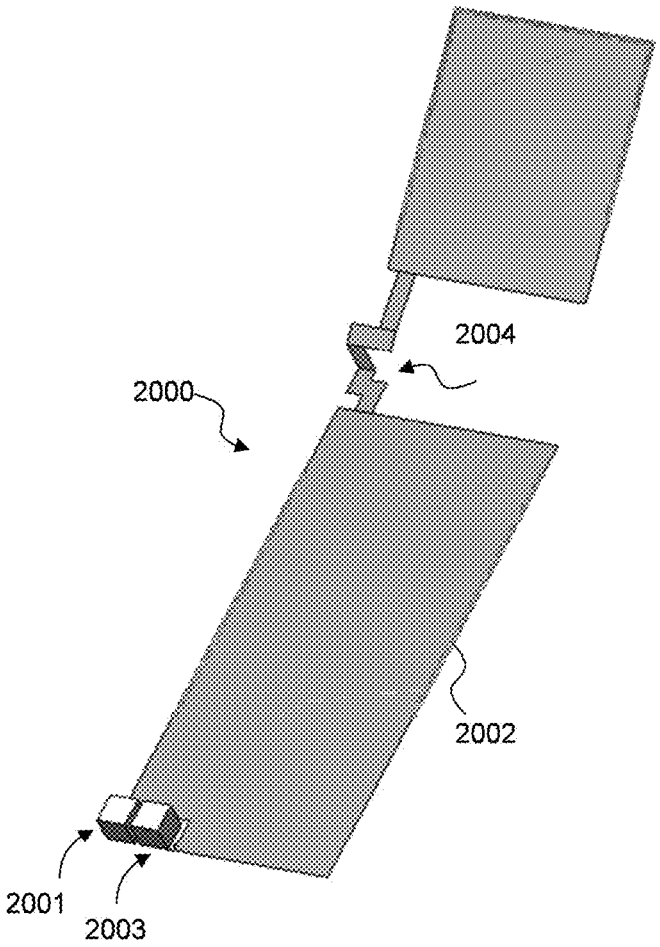
FIGS. 20*a* and 20*b*—Examples of 2 respective radiating structures for a concentrated wireless device including a first and a second radiation booster included in a clamshell phone device.
Figure 20B:
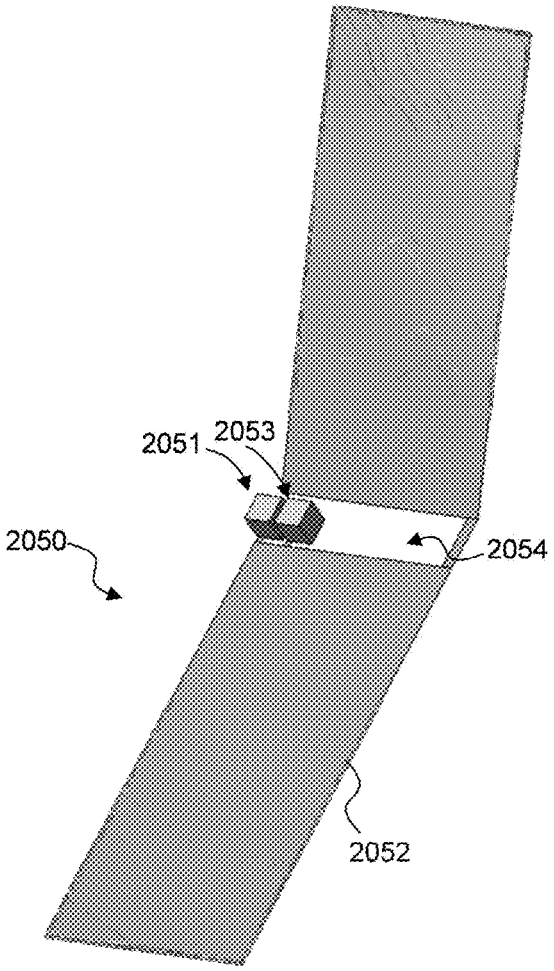

FIGS. 20*a* and 20*b* show examples of two radiating structures 2000 and 2050 representative of a clamshell phone device. The radiating structure 2000 comprises two radiation boosters 2001 and 2003 and a ground plane layer 2002. The location of the ground plane booster 2002 and 2003 is close to a corner of the ground plane layer 2002 in the furthest edge from the hinge area 2004. This situation is advantageous to reduce SAR (Specific Absorption Rate). The radiating structure 2050 shows a similar example of a radiating structure 2050 comprising two radiation boosters 2051 and 2053 placed in the edge close to the hinge area 2054.

Figure 21A:
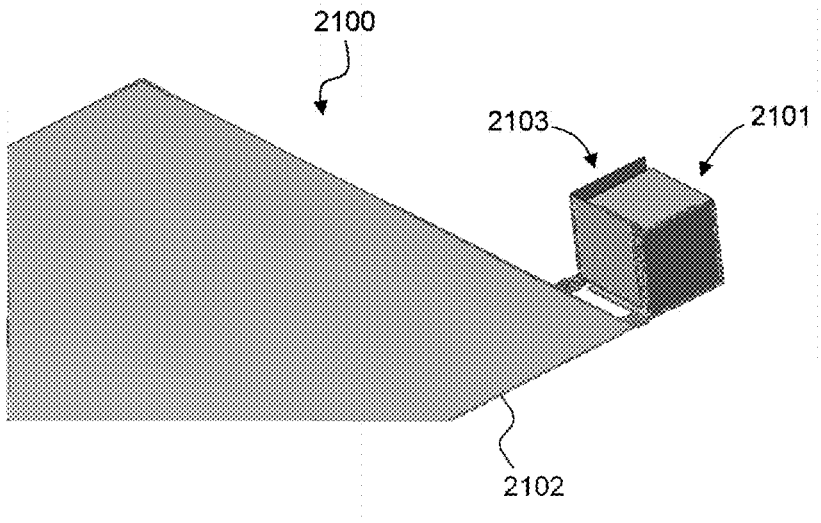
FIGS. 21*a*-21*c*—Examples of 3 respective radiating structures for a radiating system including several concentrated configurations of radiation boosters.
Figure 21B:
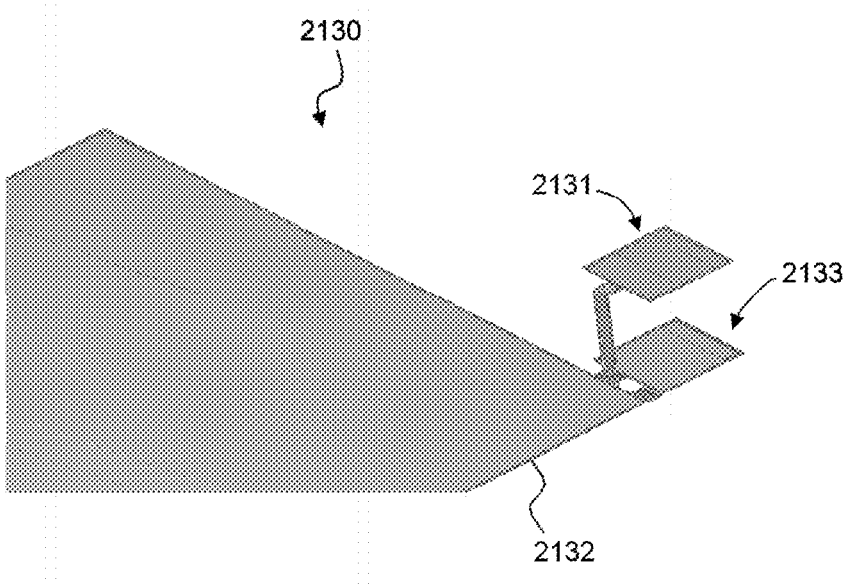
Figure 21C:
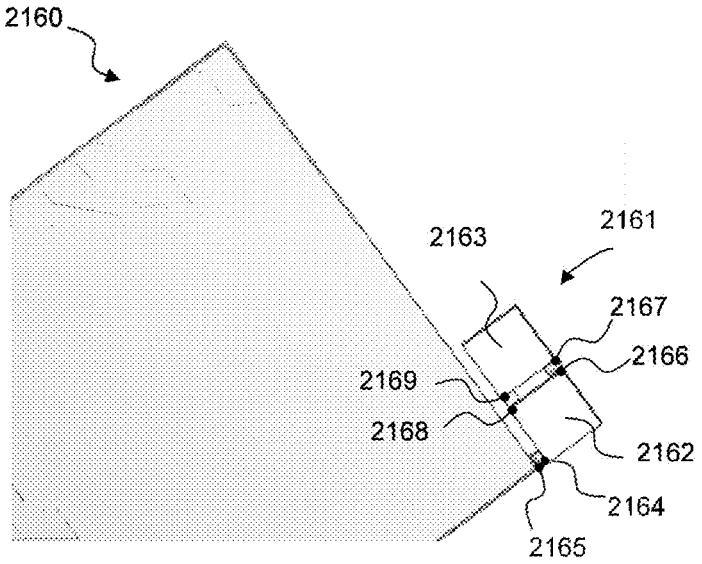

FIGS. 21*a*-21*c* show several examples of radiation boosters.

FIG. 21*a* shows a first radiation booster 2101 and a second radiation booster 2103. The first radiation booster 2101 includes a conductive part featuring four faces of a polyhedral shape. The second radiation booster 2103 includes a conductive part featuring two faces of a polyhedral shape. Although there is no ohmic contact between the faces of the first and second radiation boosters 2101, 2103, they substantially form a cube shape. With this arrangement, the radiation boosters feature a concentrated configuration according to the present invention because the distance between the internal ports of the radiating structure is minimized.

In other examples, the first radiation booster 2101 features one, two, three, four, or even five faces of a polyhedral shape while the second radiation booster 2103 features the other/s five, four, three, two, or even one face of a polyhedral shape, so both radiation boosters form a substantially cube shape, although there is no ohmic contact between the first and second radiation boosters 2101, 2103.

In yet other examples, each of the faces of the first, second, third, or even fourth radiation boosters can form different polyhedral shapes. This configuration is clearly advantageous since many radiation boosters can be arranged occupying a minimum volume of the concentrated wireless device.

FIG. 21*b* shows an example of a radiating structure 2130 comprising a ground plane layer 2132 and two radiation boosters 2131 and 2133 featuring a conductive area having a planar shape. This configuration is another particular example of the radiating structure shown in FIG. 21*a*.

FIG. 21*c* shows a radiating structure 2160 featuring a particular arrangement for a concentrated wireless device. Said radiating structure comprises one radiation booster 2161 and one internal port defined between the connection point 2164 in the radiation booster and the connection point 2165 in the ground plane layer. The radiation booster 2161 includes a first conductive part 2162 featuring a polyhedral shape comprising six faces and a second conductive part 2163 featuring also a polyhedral shape comprising six faces. A first port is defined between a first connection point 2166 in the conductive part 2162 and a first connection point 2167 in the conductive part 2163. A second port is defined between a second point 2168 in the conductive part 2162 and a second point 2169 in the conductive part 2163. A lumped component can be located in at least one port in order to provide at least one connection or disconnection between both conductive parts 2162, 2163. In some examples, a zero ohm resistance is placed in at least one port to connect the conductive parts 2162 and 2163.

In some other examples, an inductor or a capacitor is located in at least one port. This configuration gives an extra degree of freedom to modify the input impedance at the internal port of the radiating structure 2160.

Figure 22:
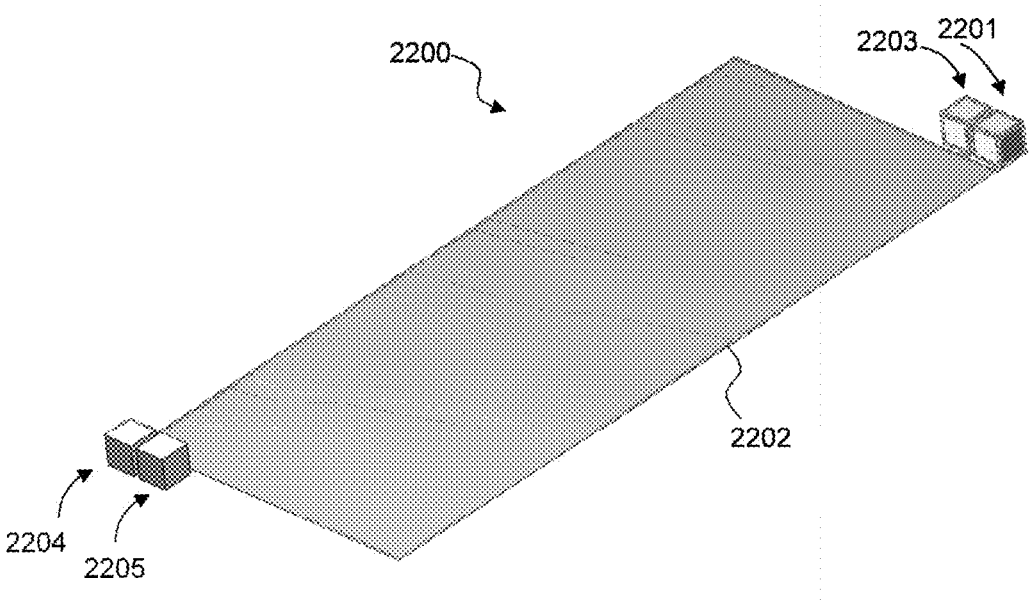
FIG. 22—Example of a radiating structure for a radiating system including two concentrated configurations, each one comprising two radiation boosters.

FIG. 22 shows a radiating structure 2200 comprising two concentrated configurations of radiation boosters according to the present invention. The first concentrated configuration comprises a first radiation booster 2201 and a second radiation booster 2203. The second concentrated configuration comprises a first radiation booster 2204 and a second radiation booster 2205.

In a particular example, the first concentrated configuration provides operation in two frequency regions of the electromagnetic spectrum and the second concentrated configuration provides operation in two different frequency regions of the electromagnetic spectrum.

In another example, the first concentrated configuration provides operation in a first and a second frequency region which are the same provided by the second concentrated configuration.

This kind of arrangement is also suitable for diversity or MIMO applications where a duplicity of concentrated configurations are needed in order to provide spatial multiplexing or space diversity in at least two frequency regions.

Figure 23:
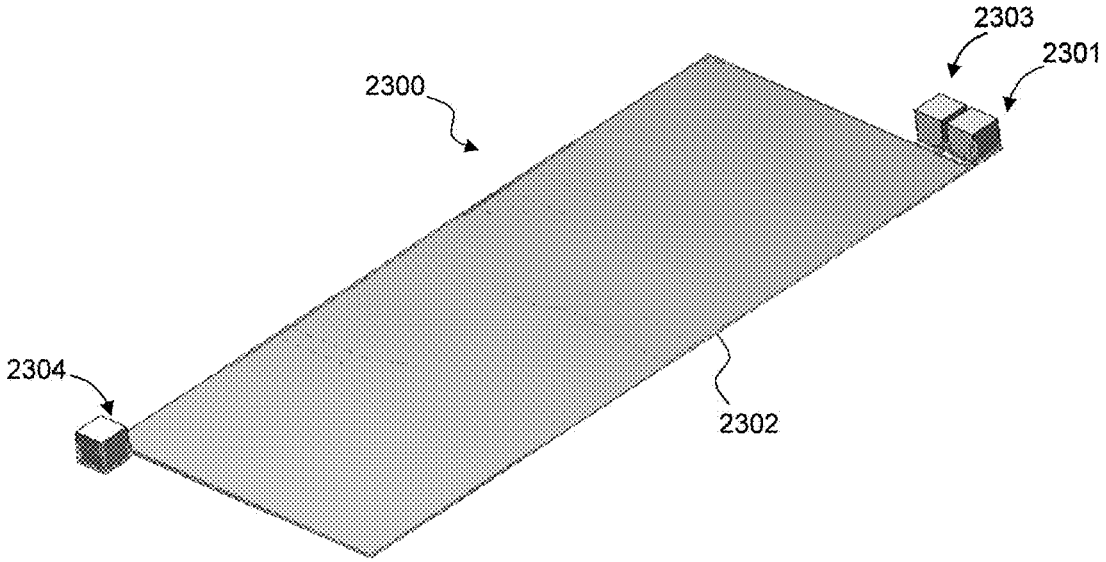
FIG. 23—Example of a radiating structure for a radiating system including a first concentrated configuration comprising two radiation boosters and a second concentrated configuration comprising one radiation booster.

FIG. 23 shows a radiating structure 2300 comprising two concentrated configurations. The first concentrated configuration comprises the radiation boosters 2301 and 2302. With the proper radiofrequency system, the second concentrated configuration comprises a radiation booster 2304. In some examples the first concentrated configuration operates at two frequency regions and the second concentrated configuration at two frequency regions different that the ones provides by the first concentrated configuration. Therefore, the radiating system operates in four frequency regions. In yet another example, the first and second concentrated configurations provides operation in at least two frequency regions which are the same for the both concentrated configurations.

The radiofrequency systems 402, 431, 461 of FIG. 4 are suitable for interconnection with the first concentrated configuration comprising the radiation boosters 2301 and 2303 of the radiating structure 2300. The radiofrequency systems 302, 331, 361, or 391 of FIG. 3 are suitable for interconnection with the first concentrated configuration comprising the radiation booster 2304 of the radiating structure 2300.

Figure 24:
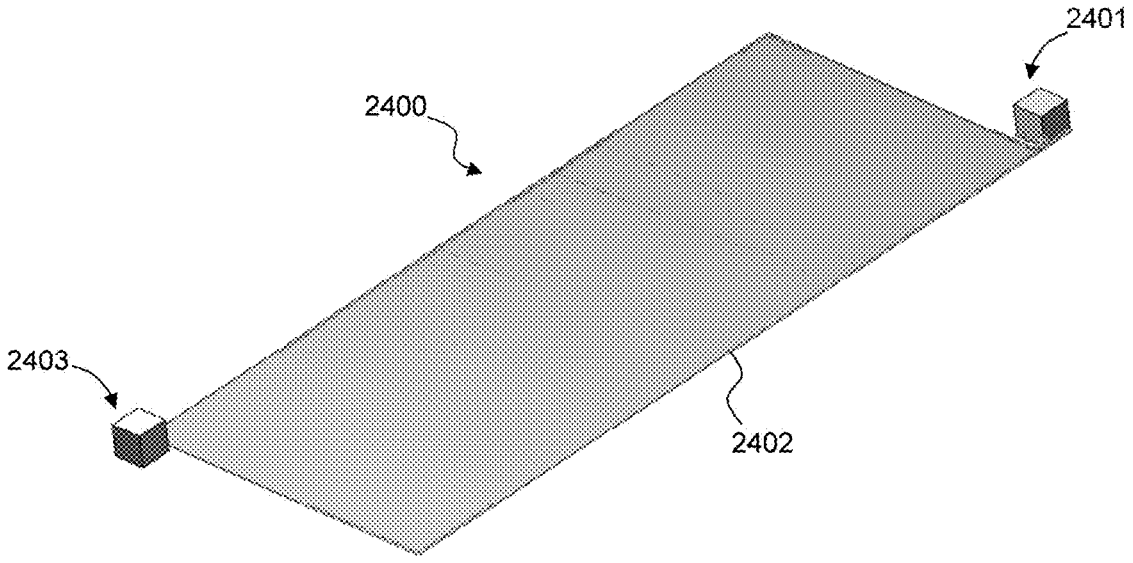
FIG. 24—Example of a radiating structure for a radiating system including two concentrated configurations, each one comprising one radiation booster.

FIG. 24 shows a radiating structure 2400 comprising two concentrated configurations. The first concentrated configuration comprises a first radiation booster 2401. The second concentrated configuration comprises a second radiation booster 2402. With the proper radiofrequency system as 302, 331, 361, or 391, the first concentrated configuration provides operation in at least two frequency regions. In a similar manner, the second concentrated configuration provides operation in two different frequency regions than the ones provided by the first concentrated configuration. In yet another example, both the first and second concentrated configurations provides operation in the same at least two frequency regions.

What is claimed is:

1. A radiation booster arrangement for a radiating system configured to transmit and receive electromagnetic wave signals in at least a first frequency region, comprising:

a first conductive part including a first connection point defining a first internal port with a first connection point in a ground plane layer of a radiating structure of the radiating system; and a second conductive part including a connection point that defines a port with a second connection point of the first conductive part;

wherein each of the first and second conductive parts has a maximum size less than 1/30 times a wavelength of a lowest frequency of the first frequency region; and wherein the second conductive part is connected to the ground plane layer only though its connection to the first conductive part.

2. The radiation booster arrangement of claim 1, wherein the second conductive part includes a second connection point that defines a second internal port with a second connection point in the ground plane layer of the radiating structure of the radiating system.

3. The radiation booster arrangement of claim 1, wherein the first and second conductive parts are spaced apart from each other by a distance in a range between 0.25 mm and 1.5 mm.

4. The radiation booster arrangement of claim 1, wherein at least one of the first and second conductive parts has a polyhedral shape.

5. The radiation booster arrangement of claim 1, wherein at least one of the first and second conductive parts has a polyhedral shape with six faces.

6. The radiation booster arrangement of claim 1, wherein each of the first and second conductive parts has a polyhedral shape with six faces.

7. The radiation booster arrangement of claim 1, further comprising a third conductive part adjacent to the second conductive part, the third conductive part including at least a connection point defining a port with another connection point of the second conductive part.

8. The radiation booster arrangement of claim 1, comprising a lumped component in at least one port defined between the first and second conductive parts.

9. The radiation booster arrangement of claim 1, comprising a zero ohm resistance in at least one port defined between the first and second conductive parts, wherein the zero ohm resistance is configured to connect the first and second conductive parts to each other.

10. A radiation booster arrangement for a radiating system configured to transmit and receive electromagnetic wave signals in at least a first frequency region, comprising:

a first conductive part comprising a first connection point, defining a first internal port with a first connection point in a ground plane layer of a radiating structure of the radiating system;

a second conductive part including at least one connection point defining a port with a connection point of the first conductive part; and a third conductive part including at least one connection point defining a port with a connection point of the first or second conductive part;

wherein at least two of the first, second, and third conductive parts each has a maximum size smaller than 1/30 times a wavelength of a lowest frequency of the first frequency region; and wherein the first, second, and third conductive parts are adjacent to, and spaced apart from, each other in a linear arrangement and the second conductive part is connected to the ground plane layer only via the first conductive part.

11. The radiation booster arrangement of claim 10, wherein the third conductive part includes a second connection point that defines a second internal port with a second connection point of the ground plane layer of the radiating structure of the radiating system.

12. The radiation booster arrangement of claim 10, wherein at least two of the first, second, and third conductive parts are spaced apart from each other by a distance in a range between 0.25 mm and 1.5 mm.

13. The radiation booster arrangement of claim 10, wherein at least one of the first, second, and third conductive parts includes at least one conductive via.

14. The radiation booster arrangement of claim 10, wherein at least one of the first, second, and third conductive parts has a polyhedral shape.

15. The radiation booster arrangement of claim 14, wherein the polyhedral shape has six faces.

16. The radiation booster arrangement of claim 10, wherein each of the first, second, and third conductive parts has a polyhedral shape with six faces.

17. The radiation booster arrangement of claim 10, further comprising a lumped component in at least one port defined between the first, second, and third conductive parts.

18. The radiation booster arrangement of claim 10, comprising a zero ohm resistance in at least one port defined between at least two of the first, second, and third conductive parts to connect the at least two of the first, second, and third conductive parts to each other.

19. The radiation booster arrangement of claim 10, wherein the radiating system is configured to operate in first and second frequency regions comprising respective frequency ranges of 824 MHz to 960 MHz and 1.71 GHz to 2.17 GHz.

20. The radiation booster arrangement of claim 10, wherein the radiating system includes:

a first external port configured to operate in first and second frequency regions including respective frequency ranges of 824 MHz to 960 MHz and 1.71 GHz to 2.17 GHz; and a second external port configured to operate in a third frequency region including a frequency range of 1.561 GHz to 1.606 GHz.

* * * * *